US005447235A

United States Patent [19]

Pharo

[11] Patent Number: 5,447,235

[45] Date of Patent: Sep. 5, 1995

[54] BAG WITH SQUEEZE VALVE AND METHOD FOR PACKAGING AN ARTICLE THEREIN

[75] Inventor: Daniel A. Pharo, Los Angeles, Calif.

[73] Assignee: Air Packaging Technologies, Inc., Valencia, Calif.

[21] Appl. No.: 276,535

[22] Filed: Jul. 18, 1994

[51] Int. Cl.[6] ..... B65D 81/03

[52] U.S. Cl. ..... 206/522; 53/403; 53/472

[58] Field of Search ..... 206/522, 591, 592, 594; 53/403, 472, 449

[56] References Cited

U.S. PATENT DOCUMENTS

| | | | |
|---|---|---|---|
| 3,523,563 | 8/1970 | Mirando . | |
| 4,155,453 | 5/1979 | Ono | 206/522 |
| 4,184,596 | 1/1980 | Avery | 206/522 |
| 4,240,556 | 12/1980 | Field | 206/522 |
| 4,597,244 | 7/1986 | Pharo . | |
| 4,793,123 | 12/1988 | Pharo . | |
| 4,872,558 | 10/1989 | Pharo . | |
| 4,874,093 | 10/1989 | Pharo . | |
| 4,918,904 | 4/1990 | Pharo . | |
| 4,949,530 | 8/1990 | Pharo . | |
| 5,129,519 | 7/1992 | David et al. | 206/592 |
| 5,272,856 | 12/1993 | Pharo . | |

FOREIGN PATENT DOCUMENTS 128326 1/1990 China .

*Primary Examiner*—Jimmy G. Foster
*Attorney, Agent, or Firm*—Donald S. Dowden

[57] ABSTRACT

An inflatable package adapted to be formed into a packaging system for retaining an article therein is formed with a pair of overlying inner panels defining a pocket therebetween adapted to retain an article therein and an inflating portion for communicating through the overlying inner panels. A pair of outer panels is provided, each outer panel overlying a respective one of the inner panels and each outer panel being associated with a different one of the inner panels to form an inflatable chamber therebetween. Overlying edge portions of the inner and outer panels are secured together, except at one side of the package where only overlying edge portions of each respective pair of the inner and outer panels are secured together and the inner panels remain unattached to each other to expose the pocket and inflating portion. The inflatable chambers are at least partially inflated with a filler medium which is communicated to the inflatable chambers through the inner panels within the inflating portion. The inflatable chambers are sealed upon inflation by inflation pressure from the inflatable chambers acting upon the inflating portion.

29 Claims, 22 Drawing Sheets

BAG WITH SQUEEZE VALVE AND METHOD FOR PACKAGING AN ARTICLE THEREIN

BACKGROUND OF THE INVENTION

1. Field of the Invention

The present invention relates generally to inflatable packages and, more particularly, to inflatable packages in which inflatable chambers are sealed by inflation pressure from the inflatable chambers.

2. Description of the Prior Art

Packaging devices, including inflatable packaging devices, have long been known. Inflatable packaging devices have substantial advantages as compared to other packaging systems. In particular, inflatable packaging devices have relatively low weight, especially when the inflation medium is air or a selected gas, thereby often saving considerable sums in shipping charges. For example, the present applicant has received U.S. Pat. No. 4,597,244 for a method for forming an inflated wrapping, in which a gift or other item is inserted into an open end of an envelope, the envelope is at least partially inflated with an inert gas and the envelope is thereafter completely sealed.

Inflatable packages also are known which involve inflating inflatable chambers to surround and fit snugly around an object to be packaged. The present applicant has invented a number of packaging devices that can be inflated by the user or shipper at the time an article is prepared for shipment. Such inflatable packaging devices are inflated by inserting a straw or similar tube through a sort of check valve and blowing air or another inflation medium between plies forming the packaging device to inflate the packaging device at the time of use. For example, the applicant has received U.S. Pat. No. 4,793,123 for a rolled-up packaging system and method including an inflatable bag in which an article is inserted and which is rolled up to assume a spiraled configuration for retaining the article.

The known inflatable packages have the disadvantage of using valves that, when made as inexpensively as possible, tend to leak or are not easily blown up and sealed upon inflation.

It has been appreciated that it is desirable to design an inflatable package which uses reliable seals rather than seals that leak and that are not easily blown up and sealed upon inflation. To this end, several inflatable packages have been proposed.

U.S. Pat. No. 4,872,558 for a bag-in-bag packaging system and U.S. Pat. No. 4,949,530 for a method for forming a bag-in-bag packaging system, both issued to the present applicant, propose a bag-in-bag packaging system in which an inflated outer bag has an article-carrying inner bag suspended therein. The sealing means disclosed involves a complicated type of seal.

U.S. Pat. No. 4,874,093 for a clam-like packaging system and U.S. Pat. No. 4,918,904 for a method for forming a clam-like packaging system, both issued to the present applicant, propose an inflatable packaging system having a clam-like configuration adapted to compress and retain an article therein. Bag portions are compressed against an article in a pocket to retain it therein. The sealing means disclosed involves a complicated type of seal.

U.S. Pat. No. 5,272,856, issued to the present applicant, proposes a packaging device, and a shipping method using the device, that is flexible, inflatable and reusable. Although there are provisions for selectively sealing the device to retain the inflation air and unsealing it to release the inflation air to deflate the packaging device, the sealing means disclosed, a reusable adhesive means, is a complicated type of seal that has a tendency to leak.

Chinese Patent Publication No. 128326 proposes a cushioning package which is provided with a plurality of chambers in communication with one another. Although the patent relates to a similar inflatable packaging device, it does not disclose the use of a variable seal for the inflatable chambers of the inflatable packaging device.

U.S. Pat. No. 3,523,563 (Mirando) proposes an integrally formed self-sealing valve having additionally integral means to render the valve airtight. A tube made of strips is placed within a single inflatable chamber at an opening thereof. The chamber comprises an item such as an inflatable ornament. When the chamber is completely inflated, an inflating rod used to inflate the chamber is withdrawn, and the strips are forced together because the pressure within the chamber is greater than atmospheric pressure; i.e. forcing the strips together into sealing engagement. However, Mirando teaches the use of only one inflatable chamber that is not part of an inflatable packaging device.

The above proposed inflatable packages are not easily blown up and sealed upon inflation using simple valves that do not leak.

SUMMARY OF THE INVENTION

It is an object of the present invention to overcome the deficiencies of the known inflatable packages by providing an inflatable package in which inflatable chambers are securely sealed.

It is another object of the present invention to provide a highly effective, flexible, inflatable packaging device that is adapted to enclose and protect an article during shipment and the like and that has a novel structure in which inflatable chambers are securely sealed.

These and other objects of the invention are attained in a flexible, inflatable packaging device that is adapted to enclose and protect an article during shipping and the like, the packaging device comprising a pair of overlying inner panels defining a pocket therebetween adapted to have an article retained therein and an inflating portion for communicating through the overlying inner panels, and a pair of outer panels each overlying a respective one of the inner panels, each outer panel being associated with a different one of the inner panels to form an inflatable chamber therebetween. A securing means secures overlying edge portions of the inner and outer panels together, except at one side of the package whereat only overlying edge portions of each respective pair of the inner and outer panels are secured together and the inner panels thereof remain unattached to each other to expose the pocket and the inflating portion thereat. An inflating means for at least partially inflating the inflatable chambers with a filler medium extends between the inner panels within the inflating portion for communicating the filler medium to the inflatable chambers. The inflatable chambers are sealed upon inflation by inflation pressure from the inflatable chambers acting upon the inflating portion.

In one embodiment of the invention, the inflatable chambers are at least substantially filled with the filler medium to at least substantially encapsulate and compress the inflatable chambers against the article to retain the article within the pocket.

In another embodiment of the invention, one of the inflatable chambers comprises a number of bonded areas connecting the inner and outer panels in a center portion of the inflatable chamber forming the inflatable chamber into a quilted chamber upon inflation.

In another embodiment of the invention, the inflatable chambers are inflated with a gas formed internally to the inflatable chambers.

In accordance with an independent aspect of the invention, there is provided a method for packaging an article that takes full advantage of the packaging device of the invention.

The above and other objects, features and advantages of the present invention will become apparent from the following detailed description of the preferred embodiments when read in conjunction with the accompanying drawings in which like numbers denote similar features.

DETAILED DESCRIPTION OF THE PREFERRED EMBODIMENTS

Figure 1:
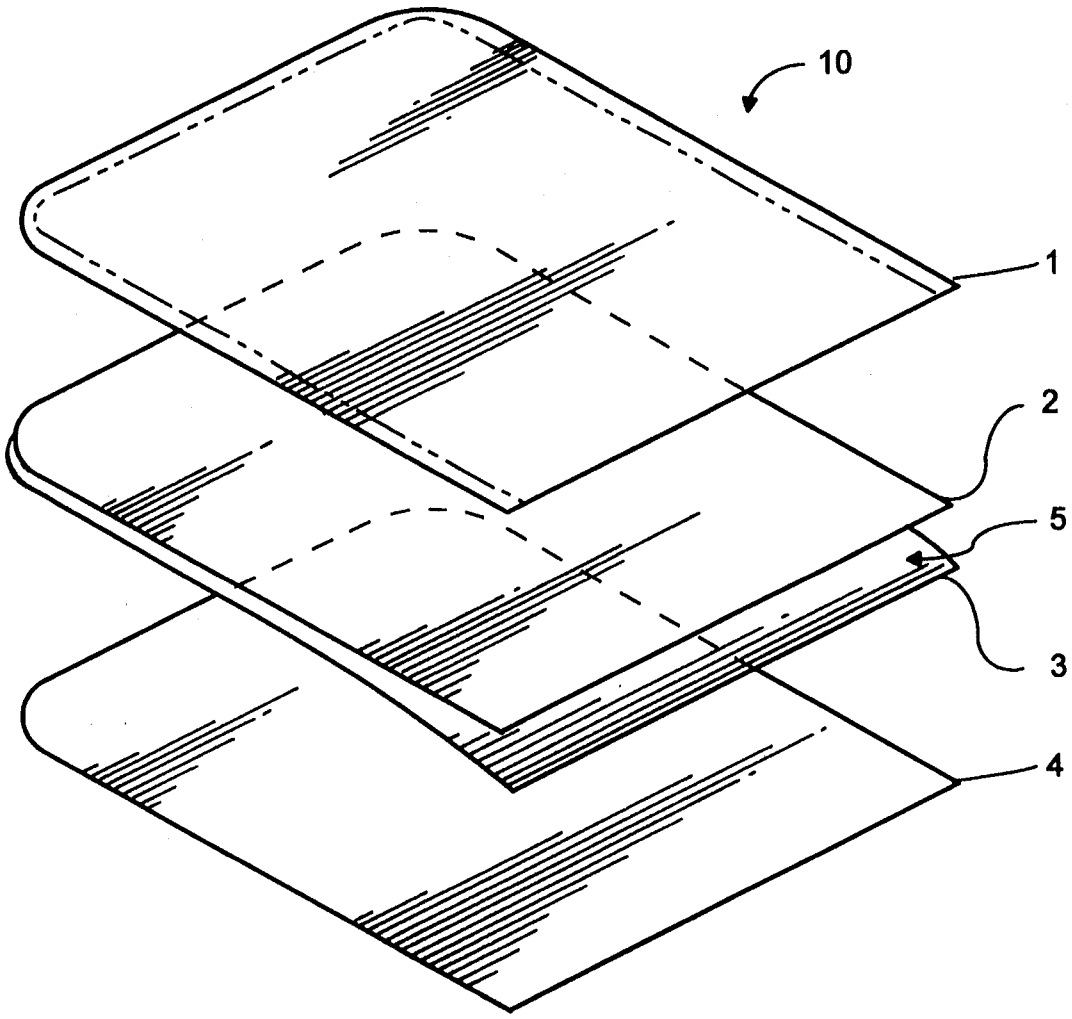
FIG. 1 is a perspective view of the structure of an inflatable packaging device according to the present invention.
Figure 2:
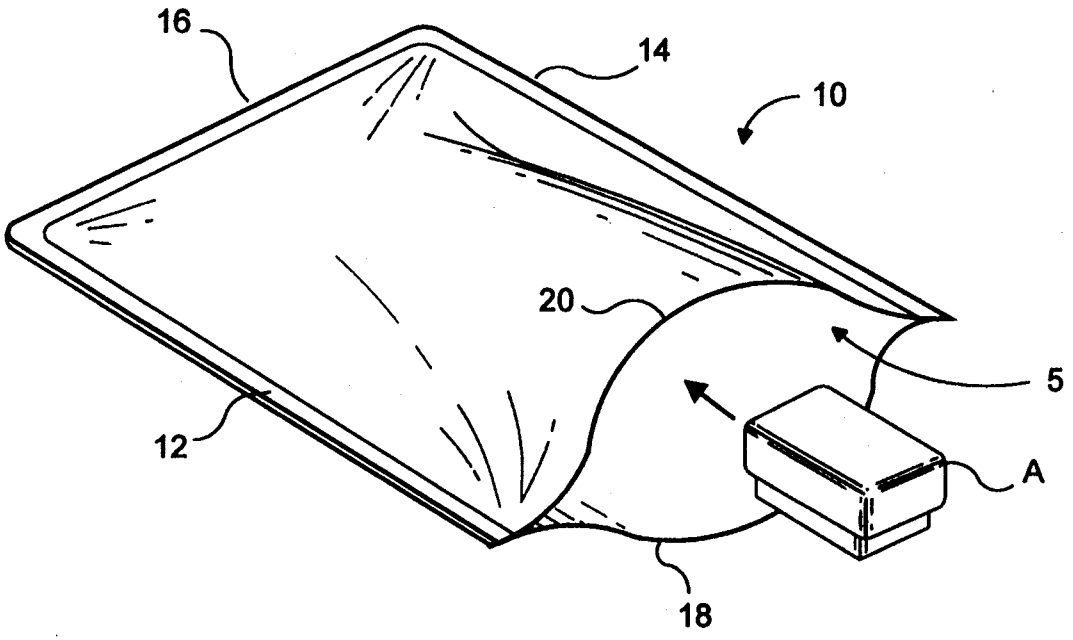
FIG. 2 is a side view of an inflatable packaging device according to the present invention showing how an article is inserted therein.

With reference to the drawings, and particularly FIGS. 1 and 2, an inflatable package according to the present invention includes a double walled inflatable packaging system 10 comprising inner panels 2 and 3 defining an item-receiving zone or pocket 5 for retaining an article A and a pair of outer panels 1 and 4 defining top and bottom major inflatable chambers (not shown) respectively therein. Article A is compressed between the inflatable chambers to retain it in a fixed position within the inflatable packaging system 10 upon inflation. The inflatable chambers may be expansion chambers where the panels 1–4 are constructed of at least a gas impervious and flexible material as described below. Alternatively, it is within the scope of this invention for the panels 1–4 to be constructed of rigid lightweight material such as a plastic of the type sometimes used in suitcases which is also gas impervious. The panels 1–4 are connected together along corresponding outer segments thereof, preferably by heat sealing techniques as described below, to form the composite package.

The opposite lateral sides of the inflatable packaging system 10 are closed by overlying side edge portions of the panels 1–4 that are sealed together to form side seams 12, 14 and 16, respectively. End edge portions 18 and 20 remain unattached to each other at the frontal side of the packaging system to expose item-receiving zone or pocket 5 which is adapted to receive article A therein when the inflatable packaging system 10 is at least partially deflated.

FIG. 2 illustrates a pre-fabricated package adapted to form the inflatable packaging system 10. The package comprises a pair of superimposed, generally rectangular and co-extensive panels 1–4 heat-sealed together at longitudinally spaced and parallel seams, formed transversely across the panels and between longitudinally spaced ends thereof.

Once the package illustrated in FIG. 1 has been prefabricated to form its open-ended envelope-like configuration as shown in FIG. 2, an article A may be inserted into the item-receiving zone or pocket 5 formed between the inner panels 2 and 3. It will be apparent that regardless of the position of the article A within the item-receiving zone or pocket 5, it will be firmly held in such position when the packaging system is inflated or otherwise charged or filled with the preselected filler medium, as described hereinafter.

The shape of the item-receiving zone or pocket 5 may be varied depending upon the article to be packaged. Thus if the article is box shaped, as is article A shown in FIG. 2, a generally rectangular item-receiving zone or pocket between the inner panels 2 and 3 may be used. The article A does not twist, turn or otherwise move or slide around laterally between the inner panels 2 and 3 of the inflatable packaging device 10 during transit.

The sheet material composing the package may comprise a gas-impervious composite laminate, such as the type described in U.S. Pat. No. 4,597,244. For example, each flexible panel 1–4 may be formed from puncture resistant sheets or laminates of polyethylene or of metallized nylon or a similar material often referred to as "Mylar". The panels may also comprise an intermediate layer of aluminum and inner and outer layers of a plastic heat-sealable coating, such as polyethylene, adapted to reactivate (melt) in the range of 300 degrees F. Such composite laminates (which may be constructed to be highly flexible and either inextensible or extensible) may be formed from two thin films bonded together with a known adhesive or brought together using hot fluid polyethylene as the bonding agent. For present purposes, it has been found suitable for the inner and outer panels 1–4 to comprise laminates having a composite thickness in the range of from about one (1) to about ten (10) mils. In the embodiment illustrated in FIG. 2, the panels 1–4 are heat sealed together along the peripheral edges thereof to form the composite inflatable packaging device 10.

Referring again to FIG. 1, exemplary common sealing areas for the four panels 1–4 are located along selected peripheral edge portions of the panels 1–4. The panels 1–4 may be suitably cut and sealed together by conventional apparatus and methods, such as those described in U.S. Pat. No. 4,545,844. It is a particular advantage of the inflatable packaging system 10 of the present invention however that the package itself may be formed from a plurality of continuously running webs of plastic sheeting which are automatically processed into completed packaging such as by superimposing, sealing and cutting at appropriate stages and in an appropriate sequence as desired.

Figure 3:
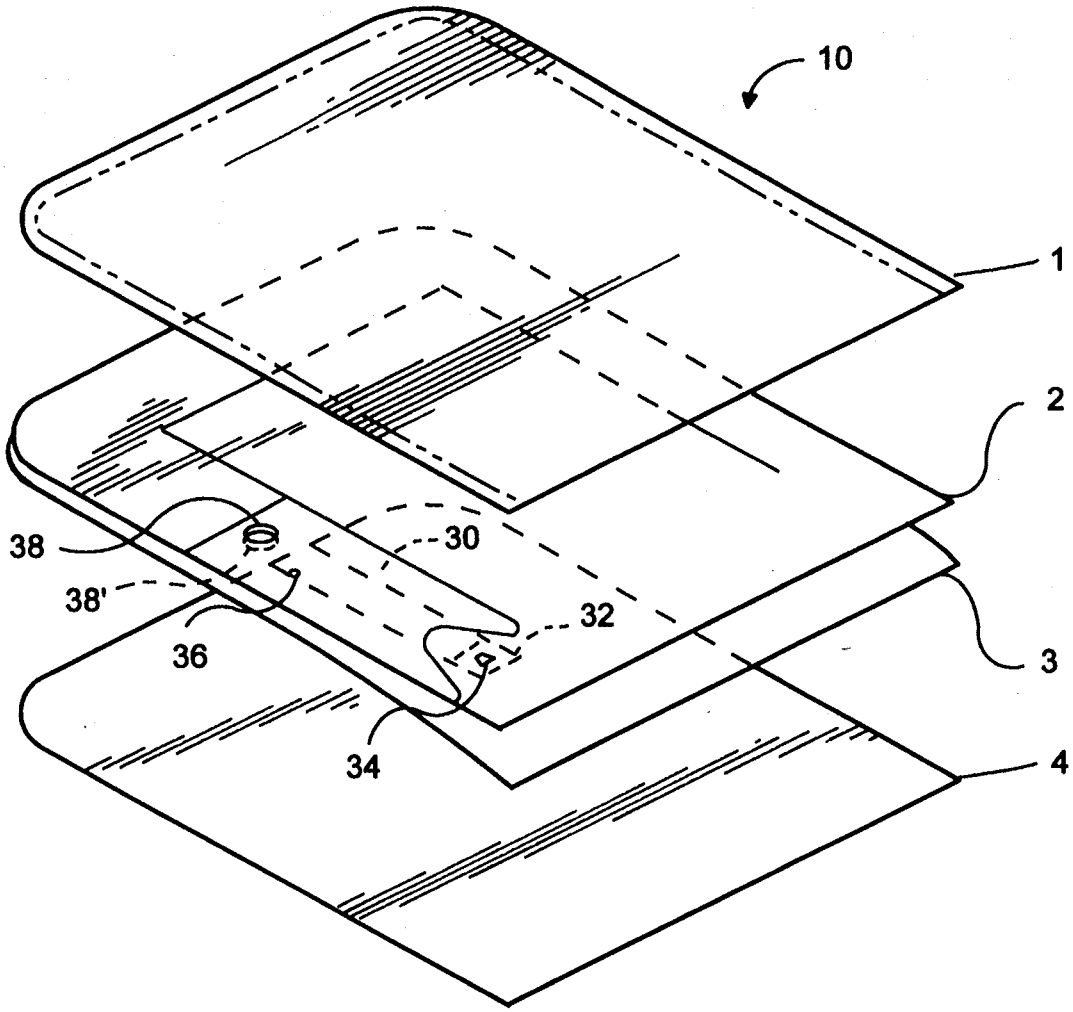
FIG. 3 is a perspective view of a first preferred embodiment of an inflatable packaging device according to the present invention.
Figure 4:
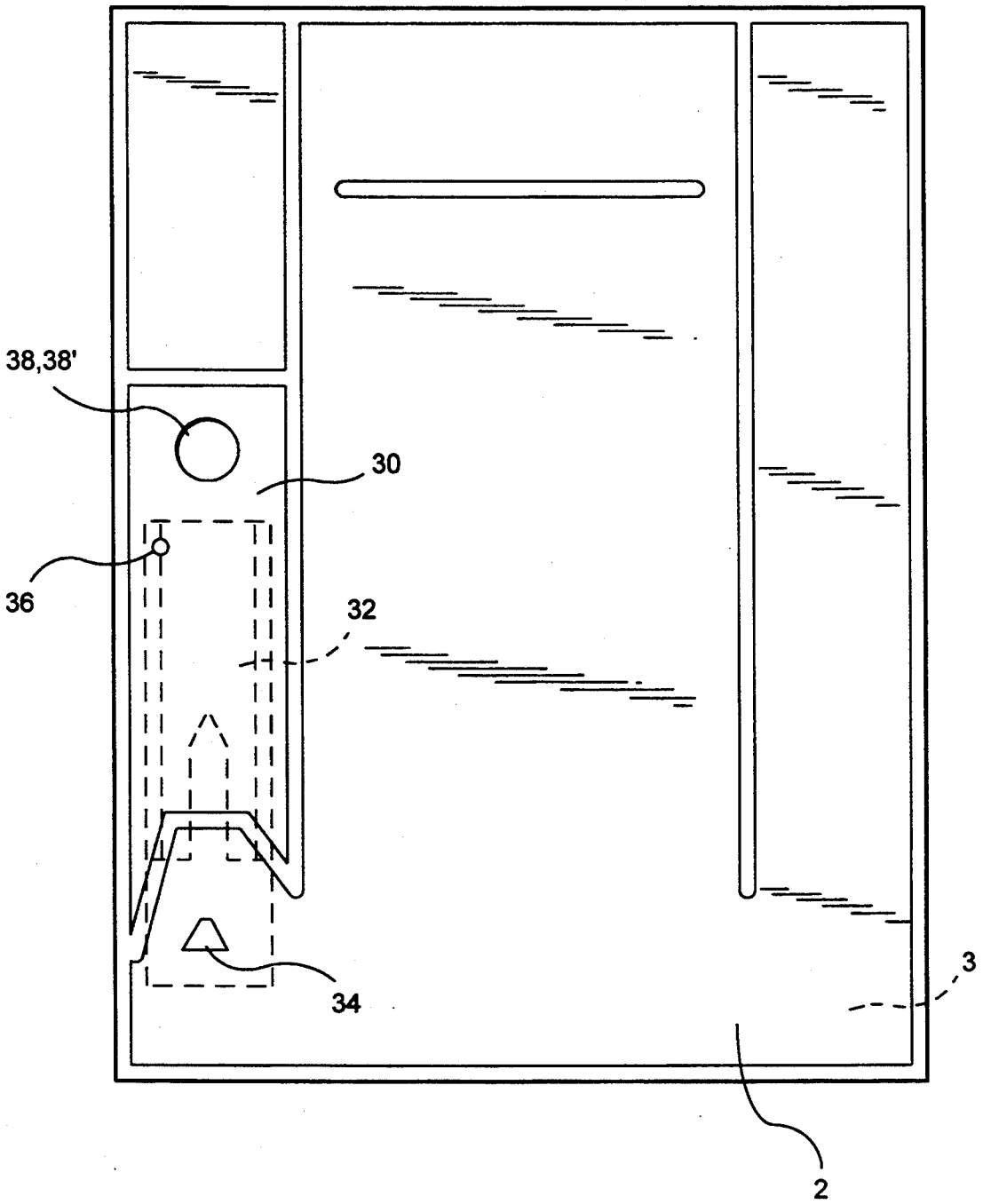
FIG. 4 is a top view of the inflatable packaging device shown in FIG. 3.

FIGS. 3 and 4 illustrate a first preferred embodiment of the present invention. An inflating portion 30 is defined by a portion of the inner panels 2 and 3 with a heat-sealed seam or other bonding method along an interior portion of the inner panels 2 and 3. The inflating portion 30 remains separate from the item-receiving zone or pocket 5. No gas or other fluid material may pass through the seam or bonding separating the inflating portion 30 from the item-receiving zone or pocket 5.

The inflating portion 30, which is formed by a portion of the inner panels 2 and 3, contains holes 38, 38' through the inner panels 2 and 3, respectively. It is through the holes 38, 38' that the filling medium is pumped into the inflatable chambers from without the inflatable packaging device 10. As described more fully hereinafter, a filler medium such as pressurized air is injected into the inflating portion 30 and from there passes respectively through holes 38, 38' in the inner panels 2 and 3 within the inflating portion 30 and into the top and bottom chambers respectively on either side of the item-receiving zone or pocket 5.

Fluid-flow communication between the two inflatable chambers may be achieved in this preferred embodiment by the use of co-extensive respective holes 38, 38' through the inner layers 2 and 3 within the inflating portion 30. The holes 38, 38' are co-extensive to the extent that they overlap, allowing the filling medium to pass freely through both inner panels 2 and 3. The holes 38, 38' need not be co-extensive, as discussed below in other preferred embodiments.

An inflating apparatus of some kind may be incorporated within the inflating portion 30 to aid in the inflation of the inflatable chambers through the inflating portion 30 and to help seal the inflating portion 30 upon inflation. In the preferred embodiment illustrated in FIG. 3, the inflating apparatus comprises a flat valve 32 inserted between inner panels 2 and 3. The flat valve 32 may be composed of two pieces of the same material used to make the panels 1–4 or other suitable material. The flat valve 32 would thus be formed by bonding the long edges of the material together by heat sealing heat sealing or other bonding method to create a type of tunnel. The flat valve 32 may be glued or otherwise attached to the inner panels 2 and 3 by tack seals 34 and 36 at a portion of the flat valve 32 extending outside the inflating portion 30 and at a corner of the flat valve 32 inside the inflating portion 30. Thus the flat valve will not move or shift during inflation due to the tack seals 34 and 36.

Inflation of the inflatable chambers through the inflating portion 30 and the flat valve 32 is accomplished by the insertion of an inflation tube or straw (not shown) through the flat valve so that an open end of the tube or straw is located near the holes 38, 38' while the other open end of the tube or straw remains outside the inflatable packaging device 10. Inflation is accomplished by forcing the filling medium through the tube or straw, which passes through the tube or straw within the flat valve 32, into the inflating portion 30 and through the holes 38, 38' into the inflatable chambers.

After the article A has been inserted into item-receiving zone or pocket 5, a standard inflation apparatus can be utilized to charge and pressurize the inflatable chambers to an inflation pressure exceeding ambient pressure, e.g., exceeding an absolute pressure of 14.7 psi at sea level. Alternatively, human lung power can be utilized to inflate the chambers with air. It may also be desirable to cause the inflatable chambers to be filled as a result of a gas producing reaction between pre-measured amounts of selected reactant chemicals, for example baking soda and vinegar. The reactants may be provided within the package structure in the form of capsules (not shown) which may simply be crushed after the package is assembled and filled in order to allow the reactants to mix together and produce the inflating gas. Other types of gases, such as helium or carbon dioxide, can be utilized as a filler medium, as well as foam or a suitable liquid such as water.

Inflation of the chambers causes substantial encapsulation of the article A between the inner panels 2 and 3 as a result of the pressure of the filler medium within the inflatable chambers. The article A is thereby supported and held at a fixed position between the inflated inflatable chambers. Compressive forces occasioned by the pressured fluid are directed inwardly and uniformly against the exposed surfaces of the flexible inner panels 2 and 3 to compress and conform them to the contours of the article A. Retention of the article A in a fixed position within the inflatable packaging device 10 is further aided by the horizontal components of forces acting on inner surface positions of transversely disposed side seams 12 and 14 of the package.

After the inflatable packaging device 10 has been inflated to encapsulate and suspend the article A at its preselected fixed position between the inflation chambers, the inflating tube or straw is removed. A seal is formed by the inflation pressure of the inflated inflatable chambers acting upon the inflating portion 30 and any inflation apparatus such as the flat valve 32. The inflation pressure of the inflated inflatable chambers presses the inner panels 2 and 3 together so that the inflating portion 30 and the flat valve 32 are completely flattened and do not permit any of the filling medium to pass from the holes 38, 38' in the inner panels 2 and 3 to the outside of the inflatable packaging device 10. Thus a complete seal is formed in a simple manner from the effect of the inflation pressure of the inflated inflatable chambers acting upon the inflating portion 30.

Figure 5:
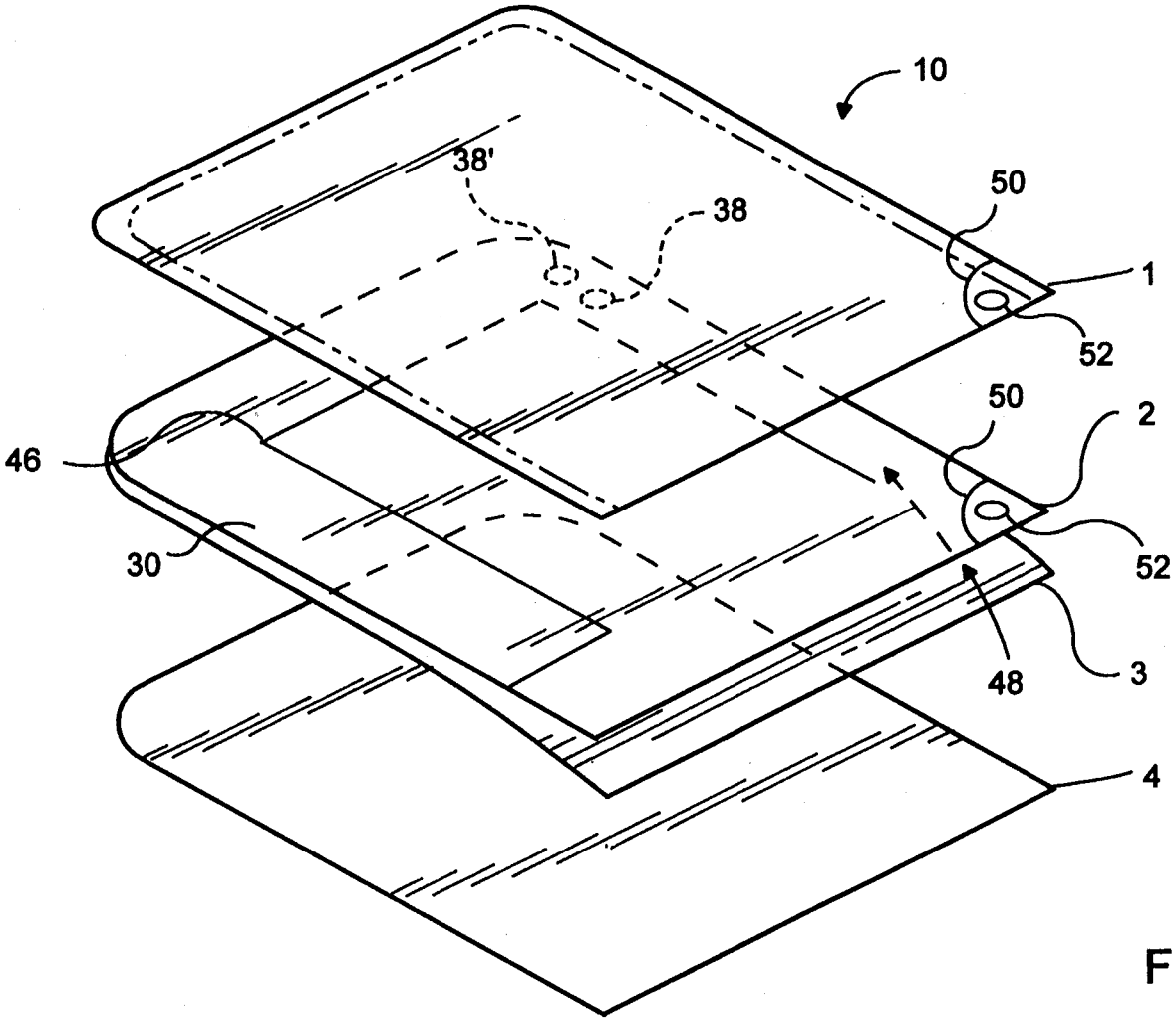
FIG. 5 is a perspective view of a second preferred embodiment of an inflatable packaging device according to the present invention.
Figure 6:
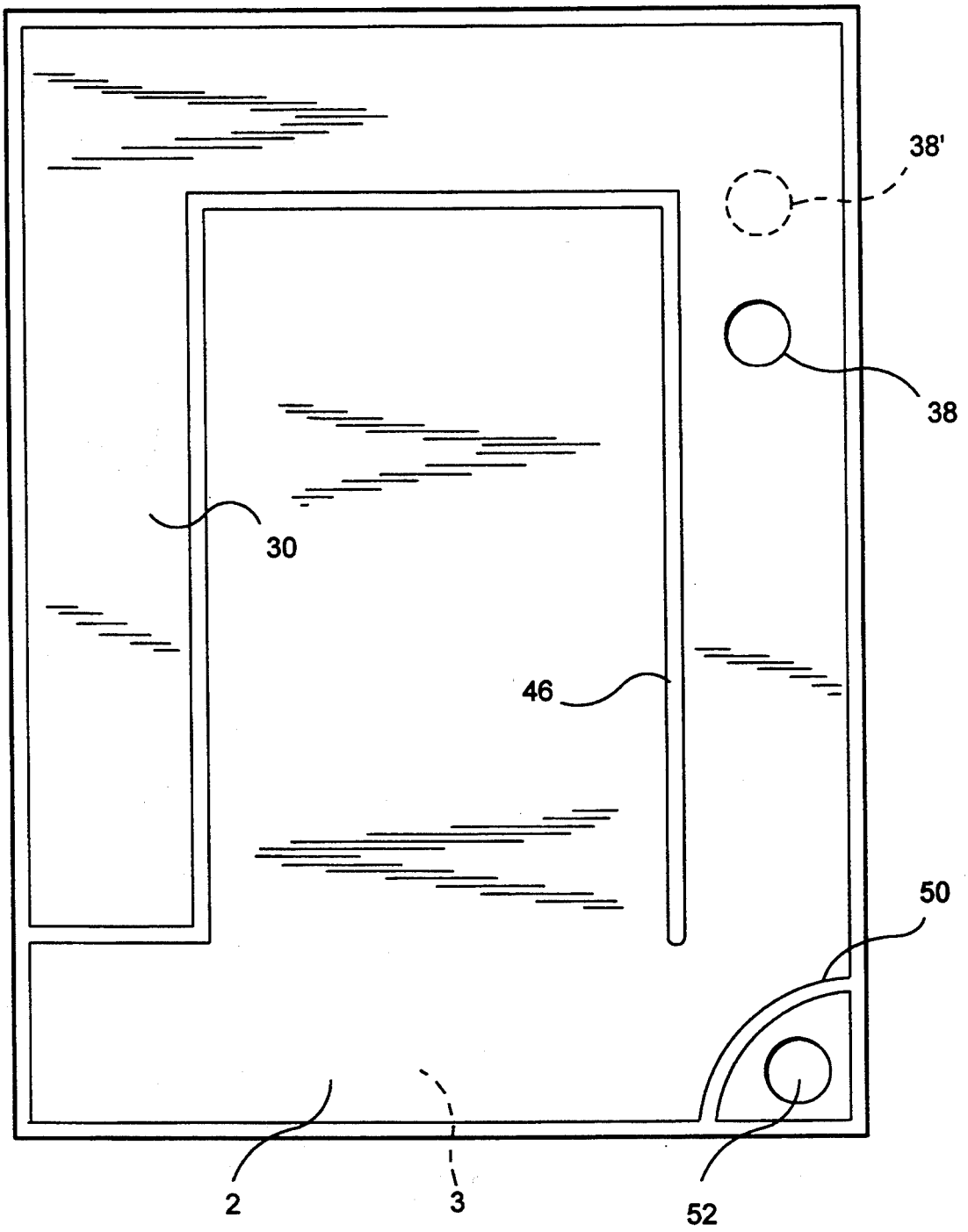
FIG. 6 is a top view of the inflatable packaging device shown in FIG. 5.

FIGS. 5 and 6 illustrate a second preferred embodiment of the present invention. In this embodiment, the holes 38, 38' in the inflating portion 30 are not co-extensive. One hole 38 is cut into inner panel 2 and allows for communication between the inflating portion 30 and the upper inflatable chamber. The other hole 38' is cut into inner panel 3 and allows for communication between the inflating portion 30 and the lower inflatable chamber. Thus, the two inflatable chambers may be inflated separately and are not in communication with each other upon inflation and sealing.

In this embodiment, the inflating portion 30 extends over a greater area along the periphery of the inner panels 2 and 3. The inflating portion 30 is defined by the solid seal lines 46 which form a bond between inner layers 2 and 3. The holes 38, 38' need not be placed next to each other, and can be placed anywhere between the solid seal lines 46 and the side seams 12, 14 and 16.

The inflatable packaging device 10 according to this embodiment may also be constructed with a solid seal 50 at one corner of one pair of outer and inner panels 1 and 2, such as those creating the upper inflatable chamber as depicted in FIG. 5. The solid seal 50 prevents the inflation medium from inflating that corner of the upper inflatable chamber. Further, there are holes 52 cut through the pair of outer and inner panels 1 and 2 in the portion of the corner which is not inflatable. This arrangement allows for external items to be attached to the inflatable packaging device such as an identification tag (not pictured) on a string which is tied through the holes 52 and around the edge of the panels 1 and 2.

Inflation is accomplished using an inflation device such as an inflation tube or straw inserted into the opening 48 at one end of the inflating portion 30. When the upper and lower inflatable chambers have been inflated with the inflating medium, the inflation device is removed, allowing the inflation pressure to press the inner panels 2 and 3 against the holes 38, 38' and together along the entire width of the inflating portion 30 to restrict the flow of the inflating medium into or out of the inflatable chambers, thus sealing the inflated inflatable chambers.

Figure 7:
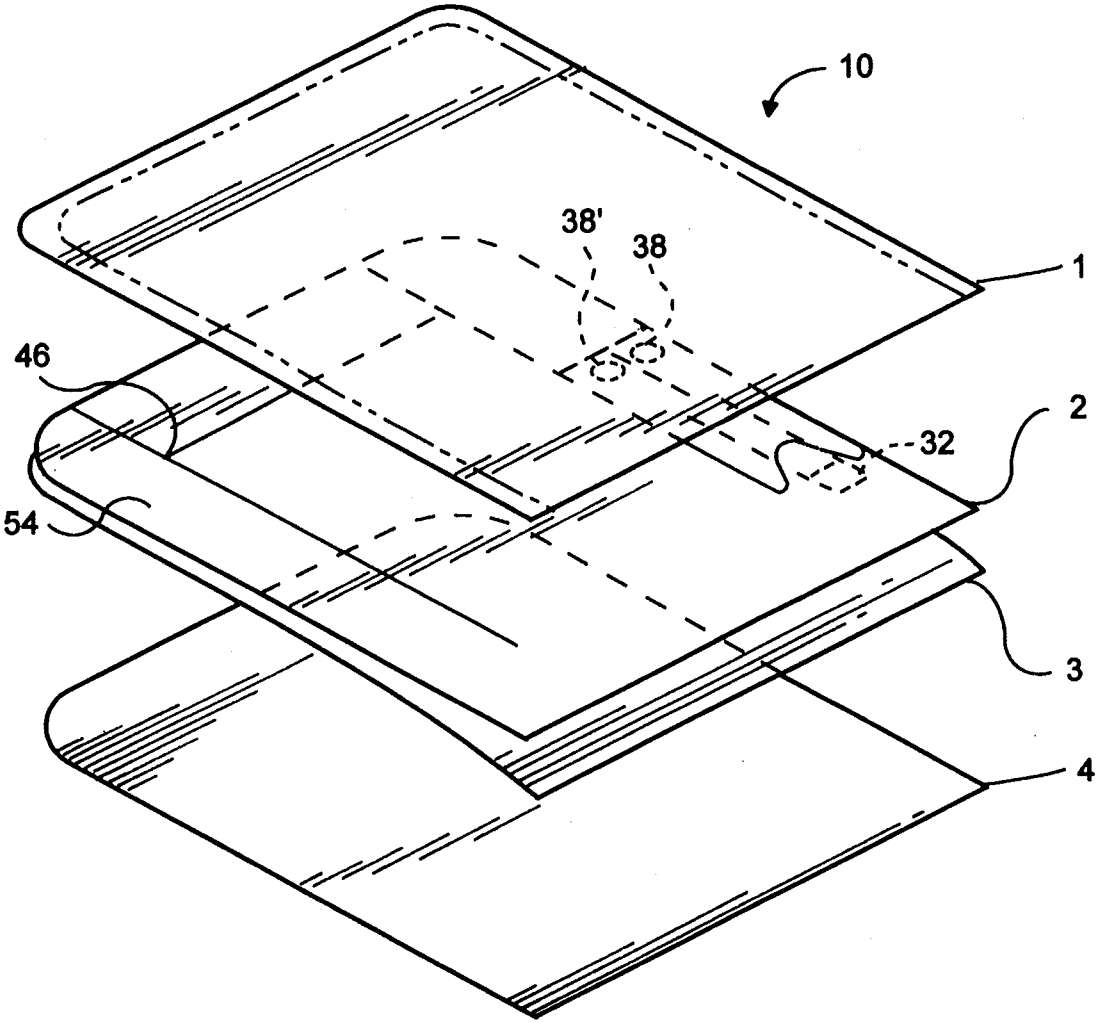
FIG. 7 is perspective view of a third preferred embodiment of an inflatable packaging device according to the present invention.
Figure 8:
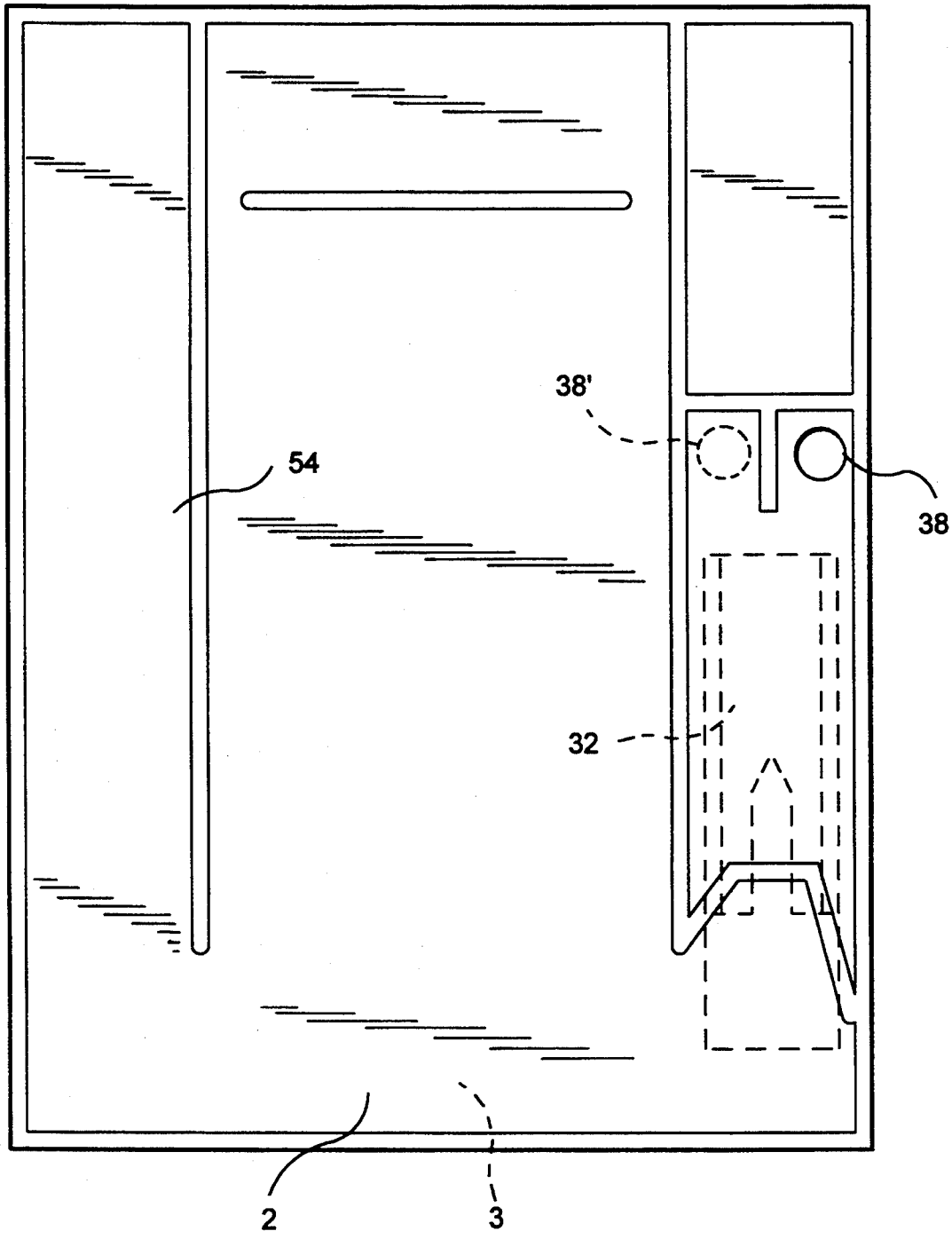
FIG. 8 is a top view of the inflatable packaging device shown in FIG. 7.

FIGS. 7 and 8 illustrate a third preferred embodiment of the present invention. In this embodiment the holes 38, 38' in the inflating portion 30 are not co-extensive. From a top view, the hole 38 through the inner panel 2 lies next to the hole 38' through the inner panel 3. The holes 38, 38' are separated by a solid seal line, formed by heat sealing or other bonding method, bonding the inner panels 2 and 3 together along a line between the holes 38, 38' while still allowing access to the holes 38, 38' for inflation of the inflatable chambers.

In this embodiment, there is also a flat valve 32 as described above. Further, a pocket 54 is created to store an inflation and/or deflation device, such as an inflation tube or straw, along the opposite side seam from where the inflating portion 30 is located. The pocket is formed by a solid seal line, formed by heat sealing or other bonding method, bonding the inner panels 2 and 3 whereby the pocket has an opening adjacent to the item-receiving zone or pocket 5. The inflation and/or deflation device may be stored in the pocket 54 when not in use.

Figure 9B:
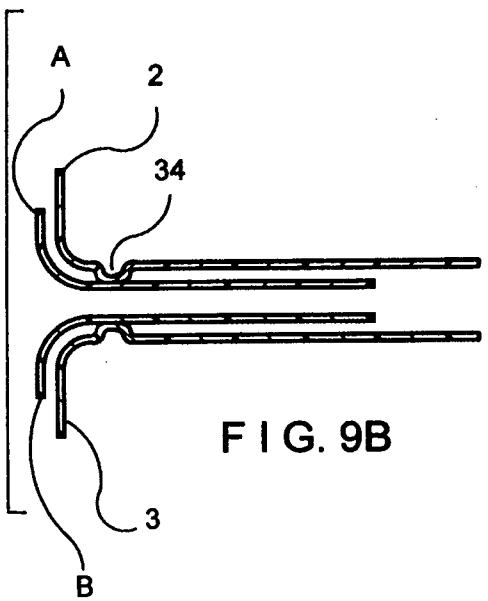
FIG. 9 is perspective view of a fourth preferred embodiment of an inflatable packaging device according to the present invention.
Figure 9:
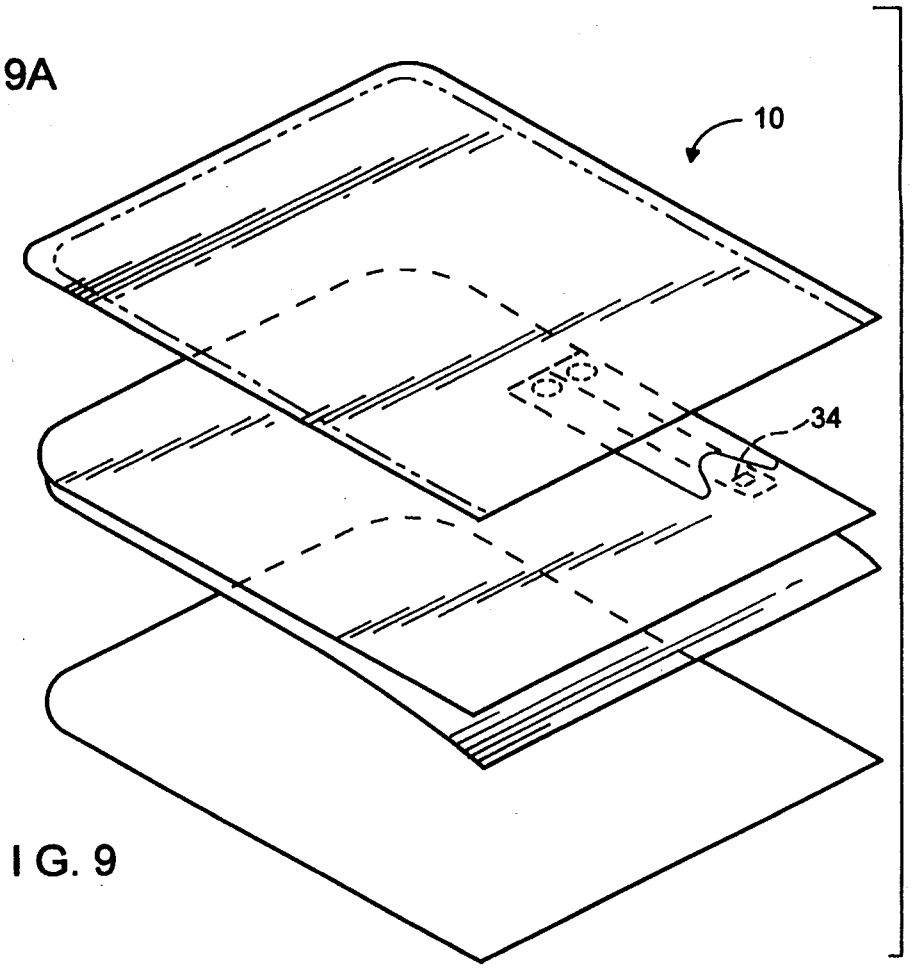
Figure 9A:
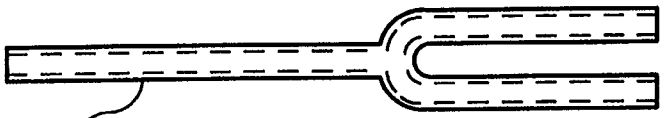
Figure 10:
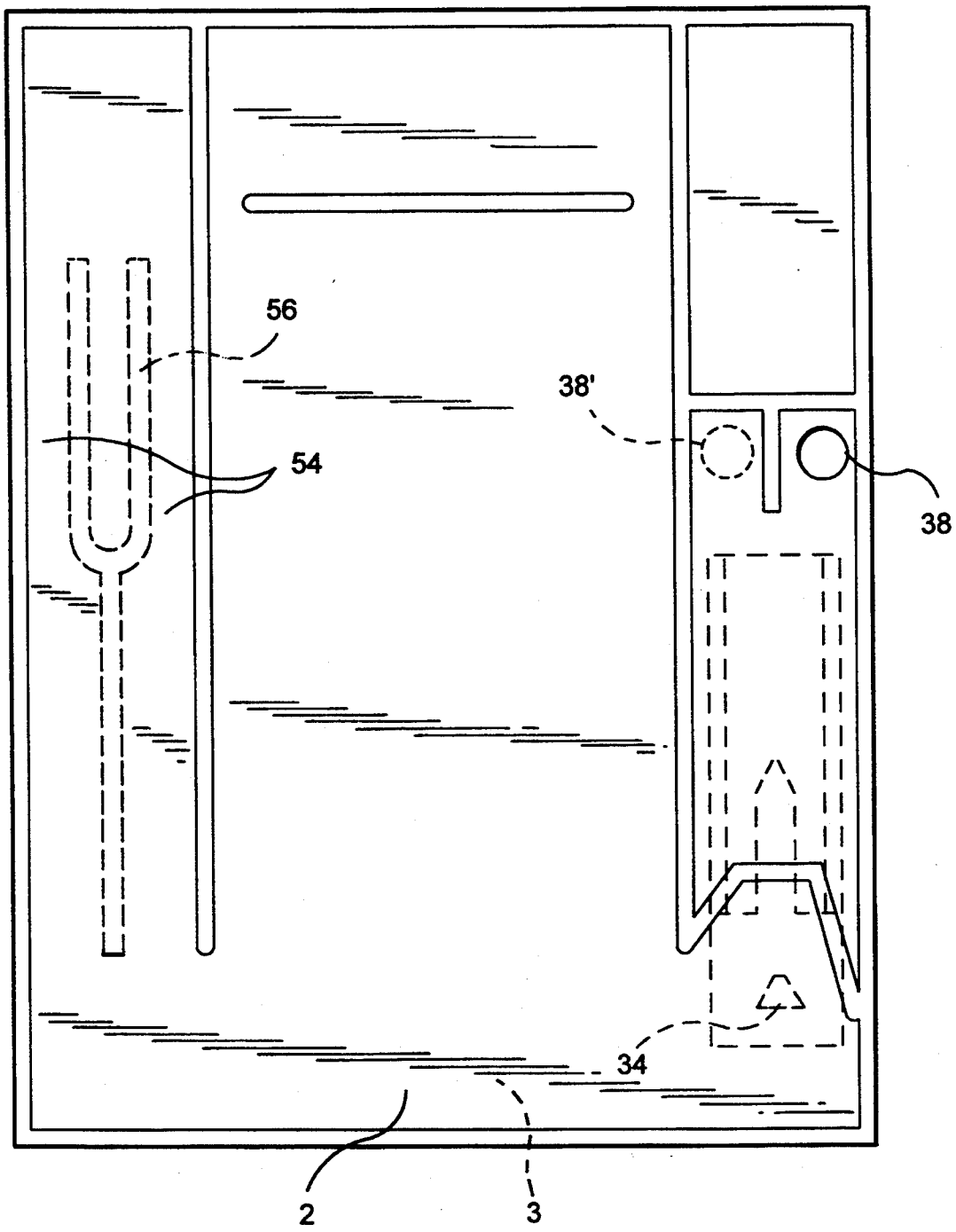
FIG. 10 is a top view of the inflatable packaging device shown in FIG. 9.

FIGS. 9 and 10 illustrate a fourth preferred embodiment of the present invention. This embodiment is a variation of the embodiment illustrated in FIGS. 7 and 8. In addition to the features described above, an inflation and/or deflation device 56 is designed specifically for use with this arrangement of adjacent holes 38, 38' in the inflating portion 30. The device 56 consists of an inflation tube or straw which branches out along two arms of tubes or straws connected to the first tube or straw at a central portion. When the inflation medium is forced into the device 56 at the end with a single open tube or straw, it exits through the device 56 at the opposite end through the two arms of tubes or straws. Furthermore, the two arms of tubes or straws are separated from each other by a distance which allows for insertion of the device 56 into the flat valve 32 in the inflating portion 30 so that the open ends of the two arms of tubes or straws may be placed near or above the holes 38, 38' and straddling the seal line separating the holes 38, 38' for inflation or deflation of the inflatable packaging device 10.

Also illustrated in FIGS. 9 and 10 is the use of a tack seal 34 to seal the flat valve 32 in place within the inflating portion 30. The tack seal 34 creates a tight seal between the top and bottom layers of the flat valve 32 and the inner panels 2 and 3. The top layer, layer A, of the flat valve 32 is sealed to layer 2 by a seal, of the type hereinbefore described. Similarly, the bottom layer, layer B, of the flat valve 32 is sealed to layer 3 by a seal. Thus, none of the inflation medium can move into or out of the inflating portion 30 through any spaces between the flat valve 32 and the inner panels 2 and 3 within the inflating portion 30.

Figure 11A:
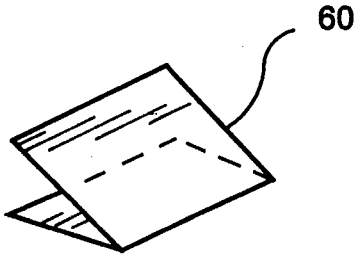
FIG. 11 is a perspective view of a fifth preferred embodiment of an inflatable packaging device according to the present invention.
Figure 11:
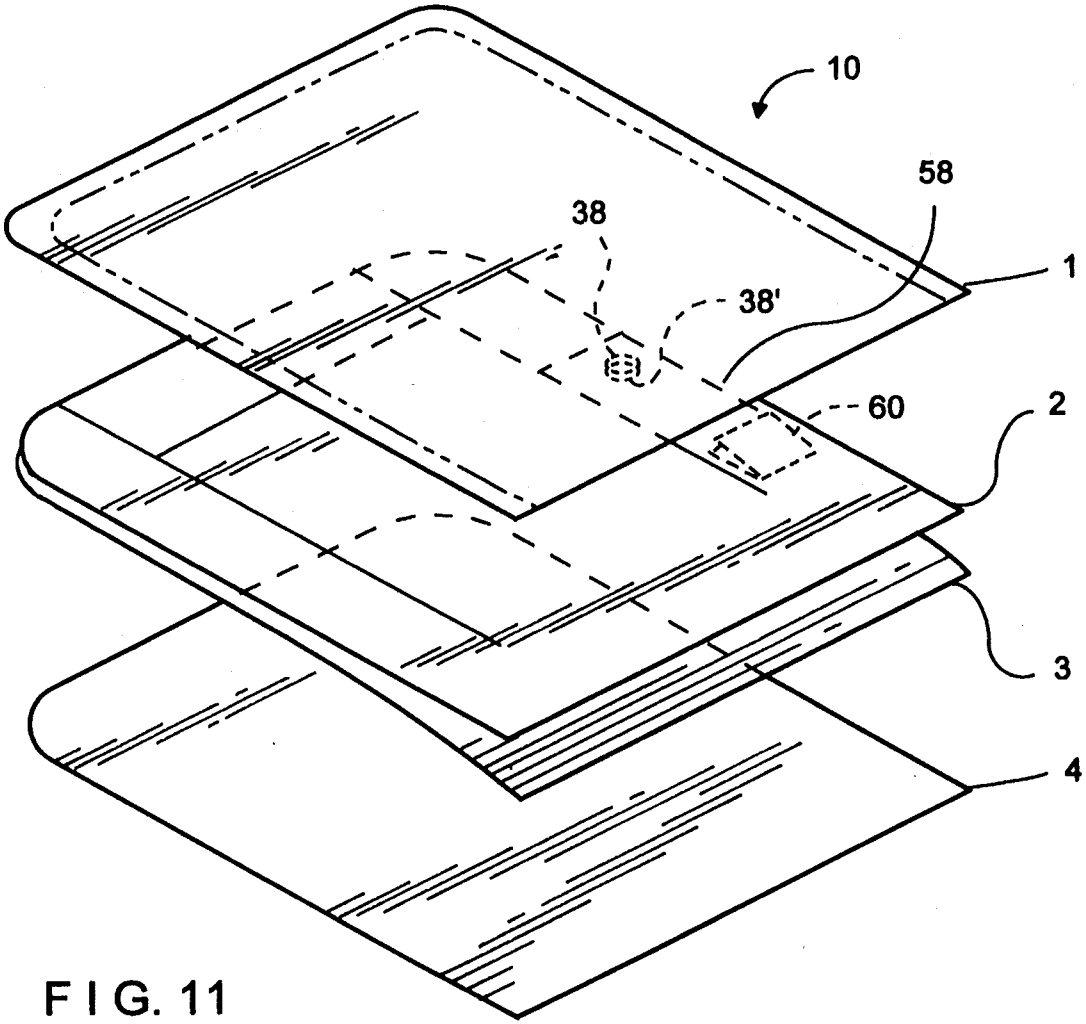
Figure 12:
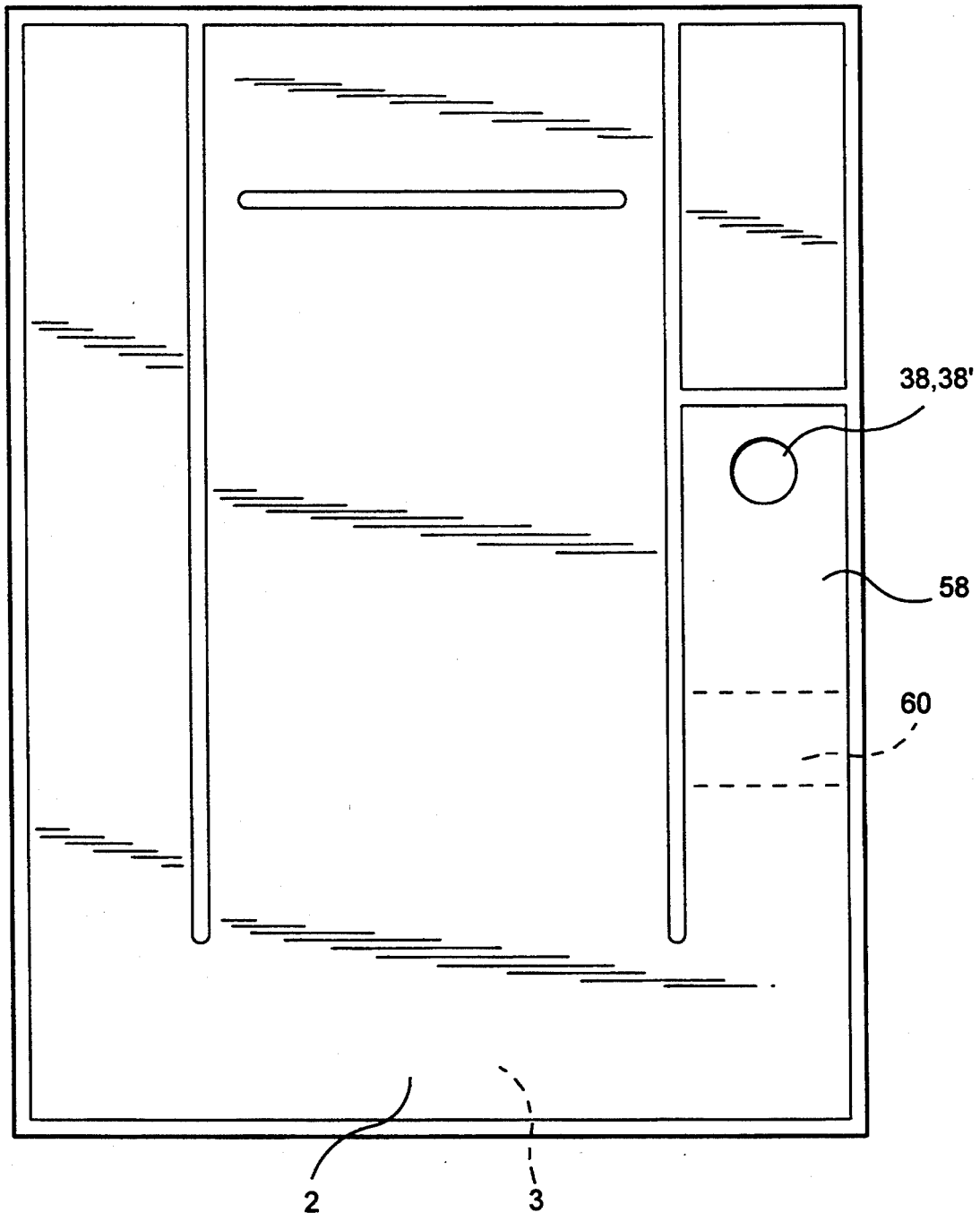
FIG. 12 is a top view of the inflatable packaging device shown in FIG. 11.

FIGS. 11 and 12 illustrate a fifth preferred embodiment of the present invention. The construction of the inflatable packaging device 10 is similar to that illustrated in FIGS. 3 and 4 as described above, except that there is no flat valve in the inflating portion 30. Instead, other mediums may be used to help seal the inflating portion 30 when the inflatable chambers have been inflated. Oil or other adhesives, coatings or inks 58 may be placed between the inner layers 2 and 3 within the inflating portion 30. The oil or other adhesives, coatings or inks 58 make the inner layers 2 and 3 stick together, thus creating another seal between the inner layers 2 and 3 within the inflating portion 30 when the inflatable chambers have been inflated. Alternatively, or in addition thereto, a blocking baffle 60 may be placed within the opening of the inflating portion 30 to help seal the inflating portion 30 when the inflatable chambers have been inflated. The blocking baffle may be a folded piece of plastic film of the same material used to construct the panels 1–4 or other suitable material. When the blocking baffle 60 is folded and placed within the opening of the inflating portion 30 upon inflation of the inflatable chambers, the blocking baffle 60 blocks the passage of the inflating medium out of the inflation portion 30, thus helping to seal the inflatable packaging device 10.

Figure 13A:
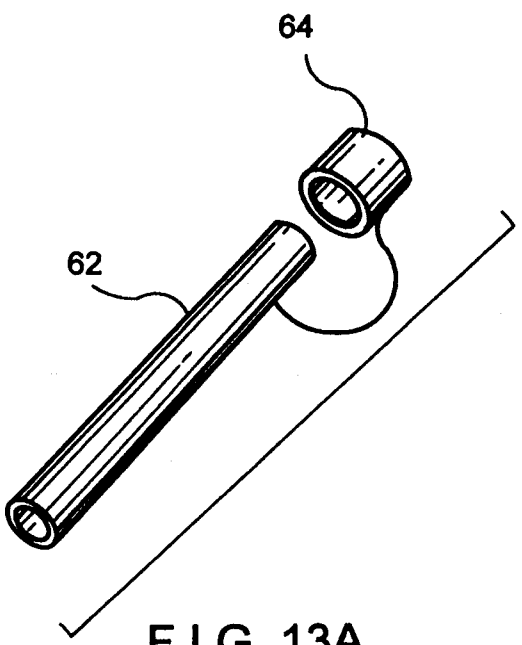
FIG. 13 is a perspective view of a sixth preferred embodiment of an inflatable packaging device according to the present invention.
Figure 13:
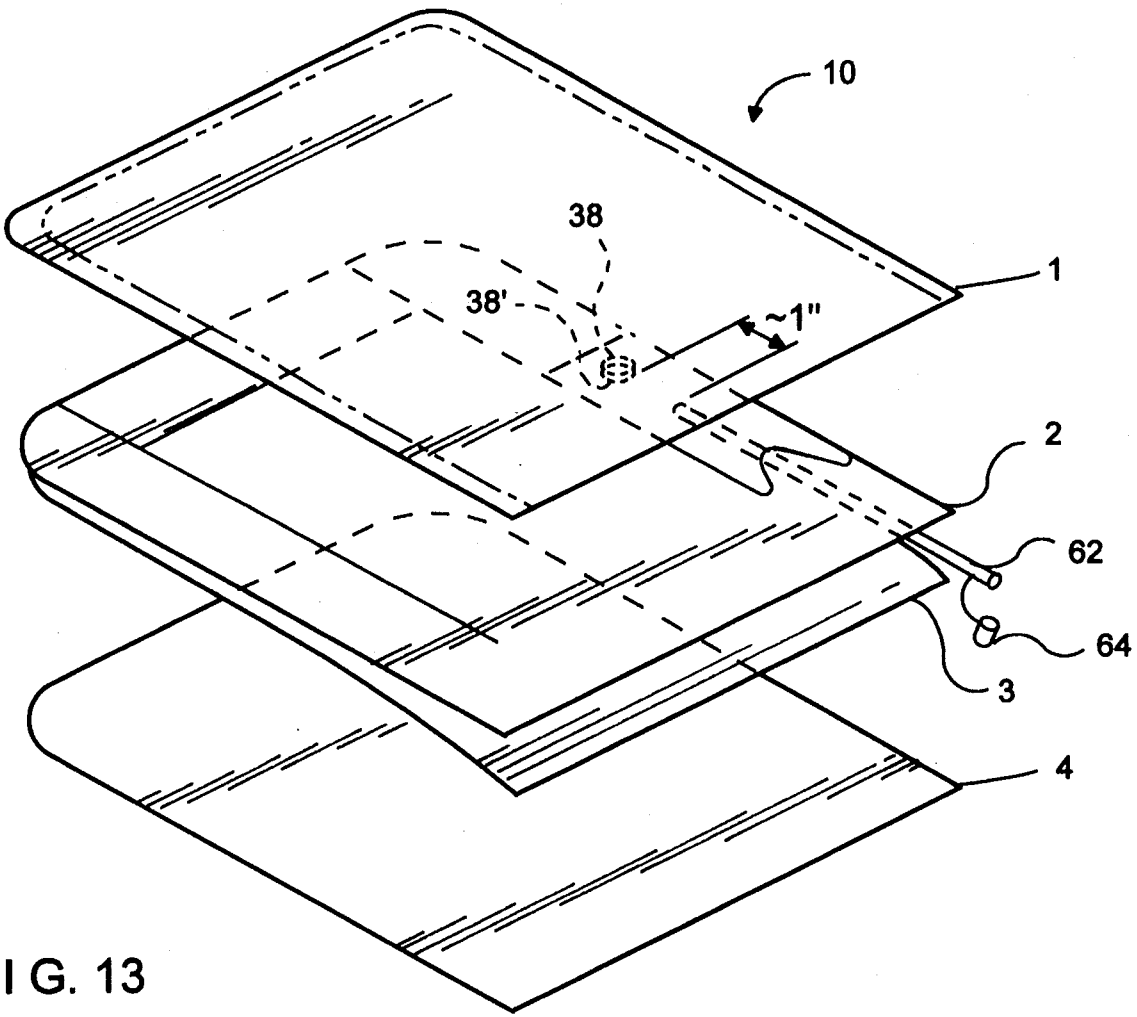
Figure 14:
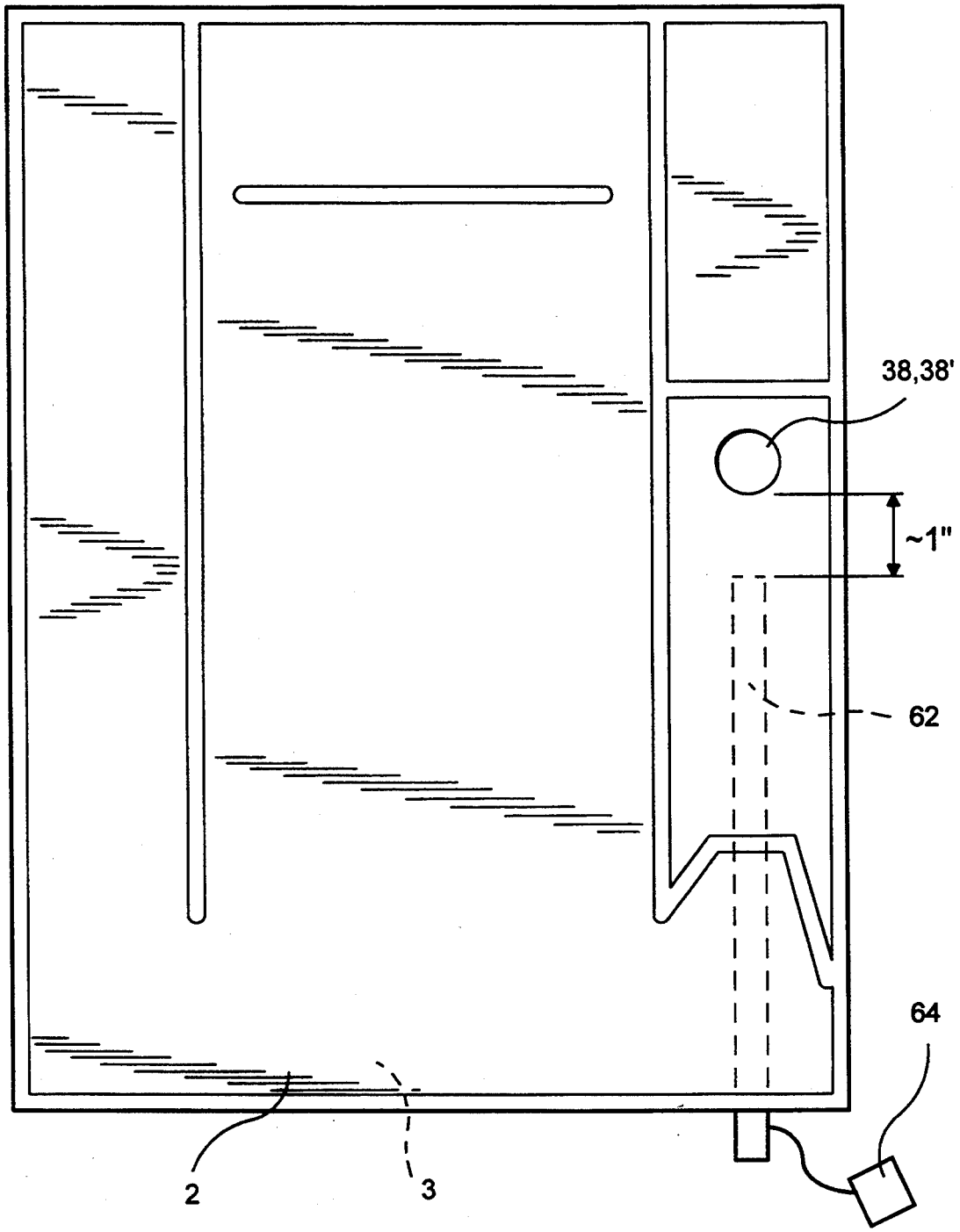
FIG. 14 is a top view of the inflatable packaging device shown in FIG. 13.

FIGS. 13 and 14 illustrate a sixth preferred embodiment of the present invention. The construction of the inflatable packaging device 10 is similar to that illustrated in FIGS. 3 and 4 and described above, except that there is no flat valve. In this embodiment, an inflation tube or straw 62 is inserted between the inner layers 2 and 3 within the inflating portion 30 and permanently sealed in place within the inflating portion 30. One open end of the tube or straw 62 is placed a fixed distance, preferably about one inch, from the holes 38, 38'. The other open end of the tube or straw 62 extends outward from the opening of the inflating portion 30 and past the edge of inner panel 2 at the opening of the item-receiving zone or pocket 5. The tube or straw 62 may also be sealed to the inner panel 2 at the edge of inner panel 2 at the opening of the item-receiving zone or pocket 5. Inflation of the inflatable chambers is thus carried out by forcing the inflation medium through the tube or straw 62 so that the inflation medium passes through the tube or straw 62 within the inflating portion 30, along the space between the first open end of the straw and the holes 38, 38', and into the inflatable chambers through the holes 38, 38' in the inner panels 2 and 3 within the inflating portion 30. The inflated inflatable chambers press against the inflating portion 30, and thus also against the tube or straw 62, helping to seal the tube or straw 62 to prevent escape of the inflating medium upon inflation of the inflatable packaging device 10.

To further assist in sealing the tube or straw 62 upon inflation of the inflatable packaging device, an attached cap 64 may be placed over the second open end of the tube or straw 62 external to the inflatable packaging device 10. The attached cap 64 should fit snugly over the end of the tube or straw 62 external to the inflatable packaging device 10 to prevent passage of the inflation medium out of the tube or straw 62 upon inflation of the inflatable chambers. The attached cap 64 may be attached to the tube or straw 62 by means of a string or thread connected to both the tube or straw 62 and the attached cap 64. Attaching the attached cap 64 to the tube or straw 62 prevents loss or misplacement of the attached cap 64 when the inflatable packaging device 10 is not in use.

Figure 15:
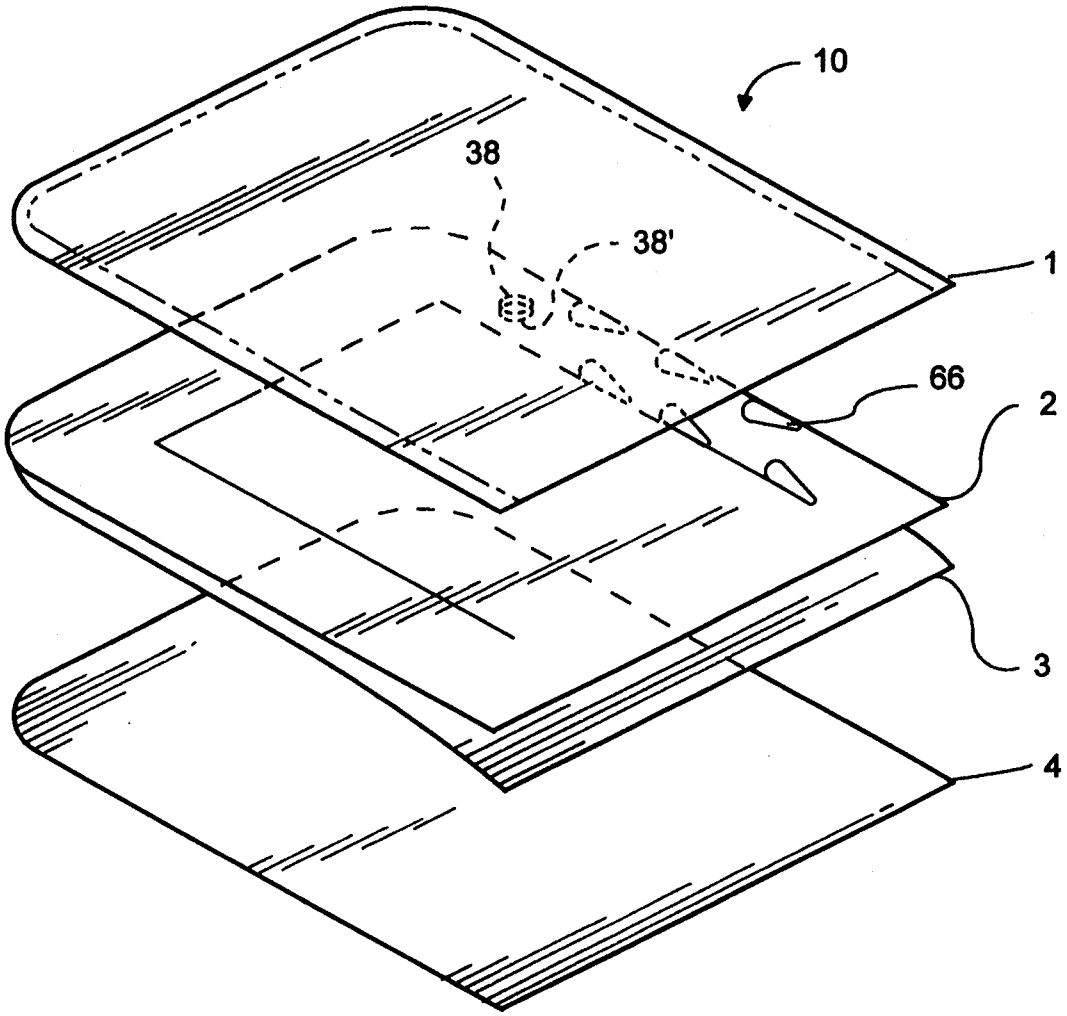
FIG. 15 is a perspective view of a seventh preferred embodiment of an inflatable packaging device according to the present invention.
Figure 16:
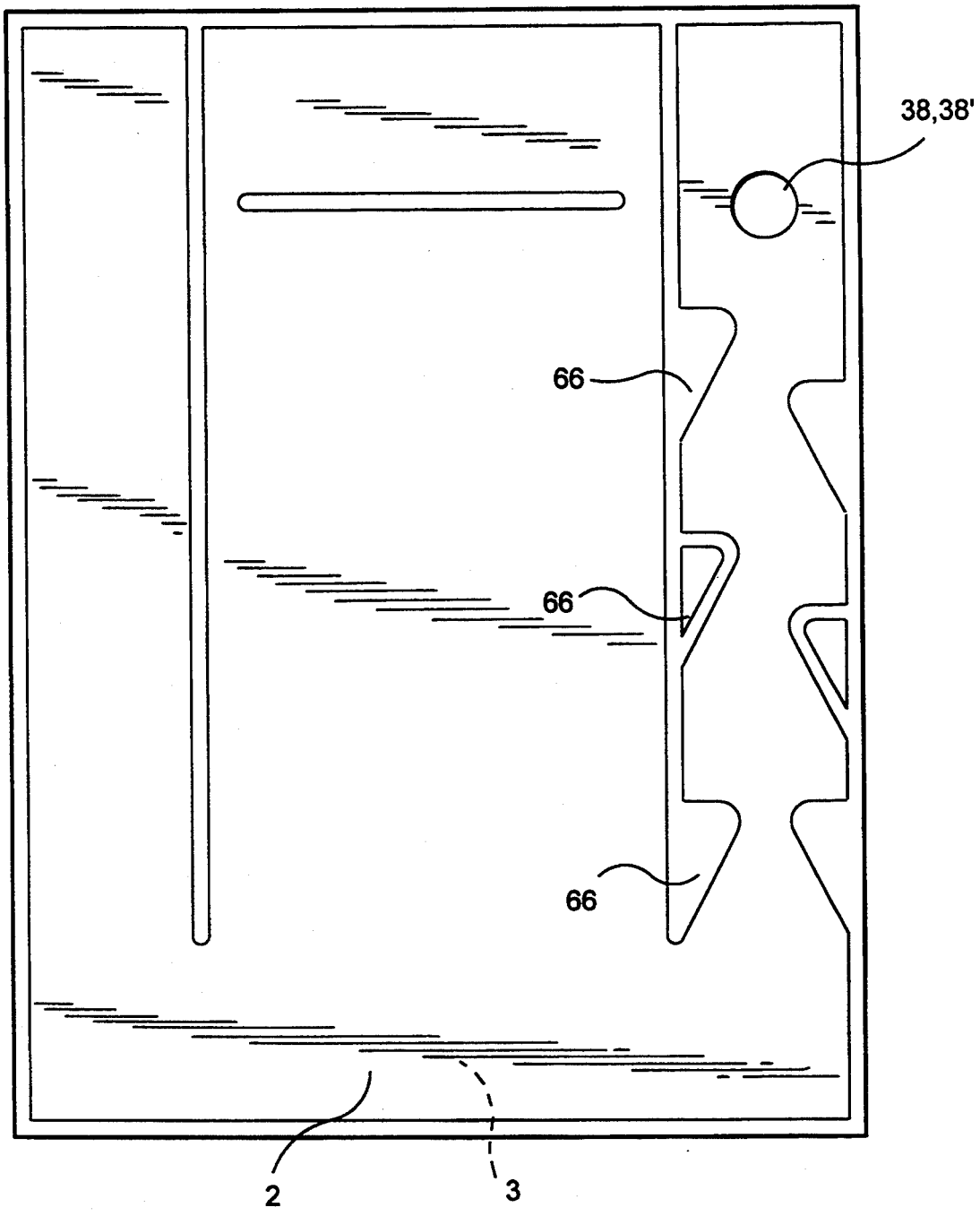
FIG. 16 is a top view of the inflatable packaging device shown in FIG. 15.

FIGS. 15 and 16 illustrate a seventh preferred embodiment of the present invention. The construction of the inflatable packaging device 10 is similar to that illustrated in FIGS. 3 and 4 and described above, except that there is no flat valve. A series of seals 66 are formed between the inner panels 2 and 3 within the inflating portion 30. The seals 66 extend from the longitudinal edges of the inflation portion 30 to a central area thereof. The seals 66 themselves may be solid seals, created by heat sealing or otherwise bonding the entire portion of the inner panels 2 and 3 within the area of the seals 66, or they may contain center portions for which the inner panels 2 and 3 are not bound together (to minimize the amount of bonding between the inner panels 2 and 3 that must be done).

The seals 66 are shaped as illustrated in FIGS. 15 and 16 to minimize the passageway through the inflating portion 30 between the holes 38, 38' and the outside of the inflatable packaging device 10. A inflation tube or straw (not pictured) should be easily insertable into the inflating portion 30 to permit inflation of the inflatable chambers. The effect of the seals 66 is to limit the size of the passageway through which the inflation medium may pass to escape from the inflated inflatable chambers to the outside of the inflatable packaging device 10. Minimizing the size of the passageway through the inflation portion 30 helps to create a better seal within the inflation portion 30 when the inflatable chambers are inflated.

Figure 17:
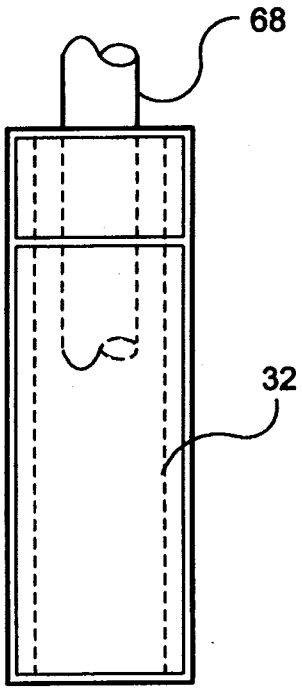
FIG. 17 is a perspective view of a tube and flat valve inflating apparatus comprising an eighth preferred embodiment of an inflatable packaging device according to the present invention.

FIG. 17 illustrates an eighth preferred embodiment of the present invention. In this embodiment, a large inflation tube or straw 68 is sealed by bonding within the opening of a flat valve 32. The open end of the flat valve 32 which lies without the inflating portion 30 completely and snugly surrounds the large inflation tube or straw 68 to form a tight seal. The large inflation tube or straw 68 thus acts as a guide through which a narrower tube or straw may be inserted into the flat valve 32 and into the inflation portion 30 to permit inflation of the inflatable chambers. This arrangement of sealing a large inflation tube or straw 68 within the opening of a flat valve 32 may be utilized in any of the preferred embodiments described herein which utilize a flat valve as an inflating apparatus within the inflating portion 30.

Figure 18:
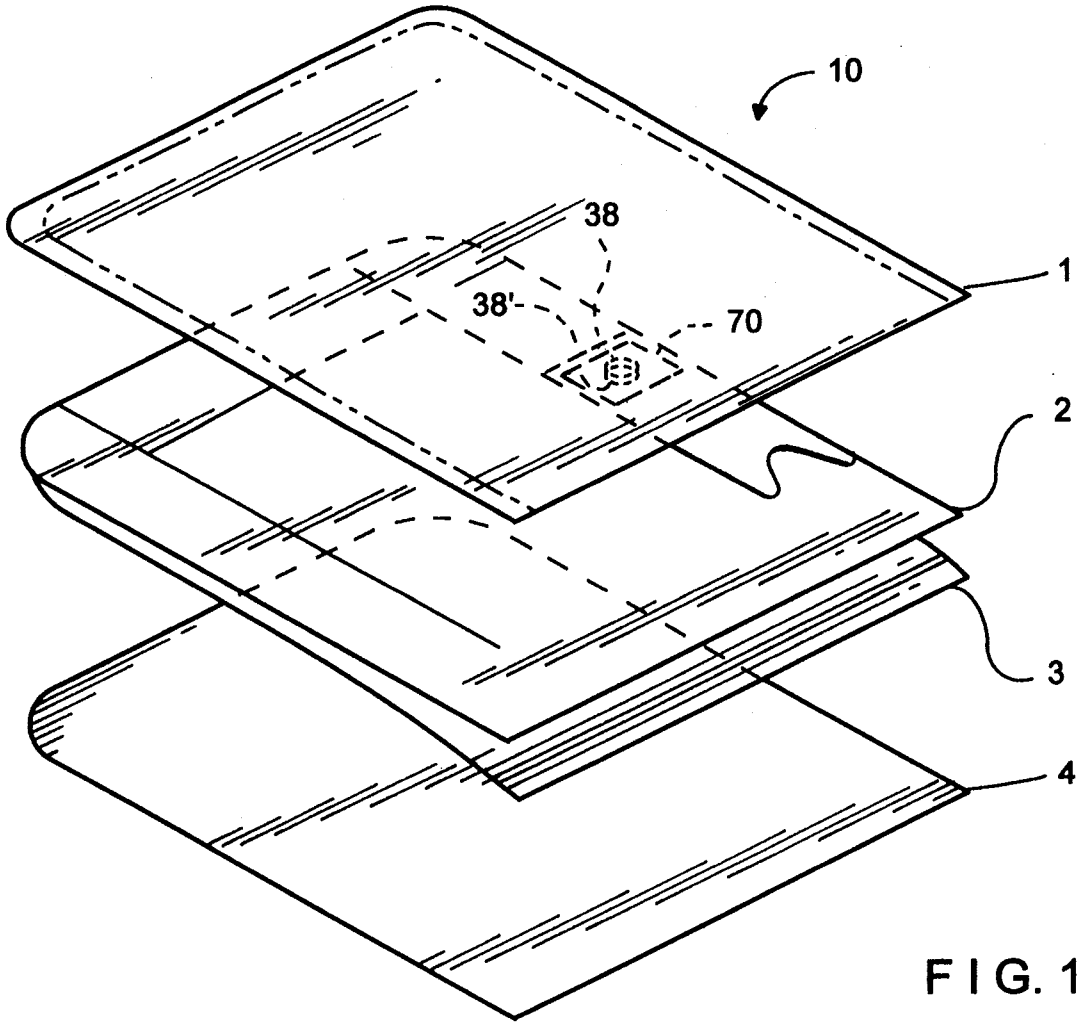
FIG. 18 is a perspective view of a ninth preferred embodiment of an inflatable packaging device according to the present invention.
Figure 19:
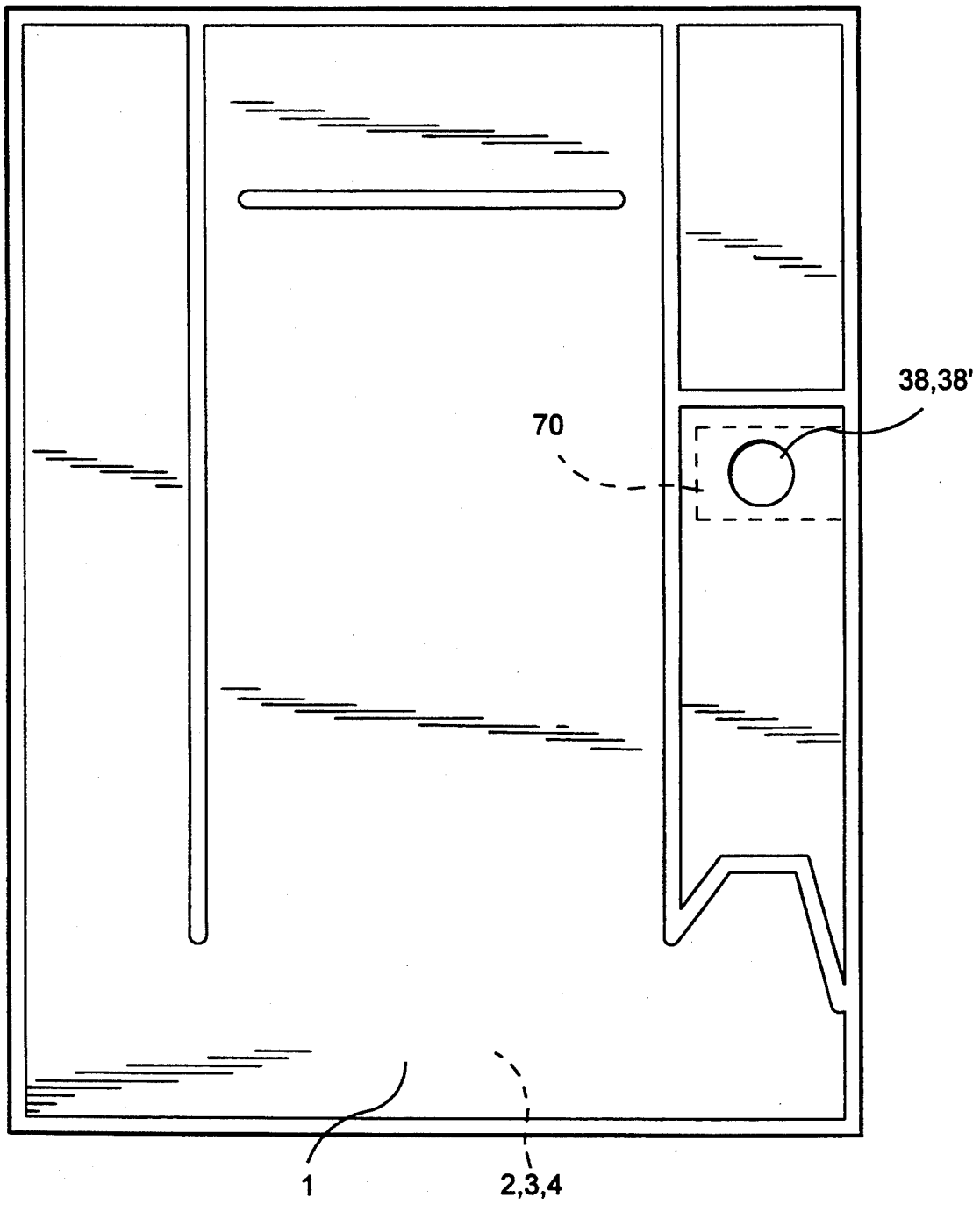
FIG. 19 is a top view of the inflatable packaging device shown in FIG. 18.

FIGS. 18 and 19 illustrate a ninth preferred embodiment of the present invention. The construction of the inflatable packaging device 10 is similar to that illustrated in FIGS. 3 and 4 and described above, except that there is no flat valve. In this embodiment, a flap 70 is placed over the holes 38, 38' within one of the inflatable chambers; i.e. either between panels 1 and 2 or between panels 3 and 4. The flap 70 is sealed in place along one of its edges by the same side seam which forms one side of the inflating portion 30. The flap 70 itself may be any shape, preferably rectangular, as long as it covers the entire area of the holes 38, 38'. Further, the flap 70 may be made of the same material used to construct the panels 1–4 or may be of any suitable material.

When the inflatable chambers are inflated, the inflation pressure within the chamber in which the flap 70 is placed, i.e. the upper inflatable chamber between panels 1 and 2, pushes the flap 70 against the holes 38, 38'. The inflation pressure pushing against the flap 70 holds the flap 70 in place, creating a tight seal over the holes 38, 38' so that none of the inflation medium can pass between the inflatable chambers or into the inflating portion 30. Thus, the flap 70 helps seal the inflatable chambers upon inflation of the inflatable packaging device 10.

Figure 20:
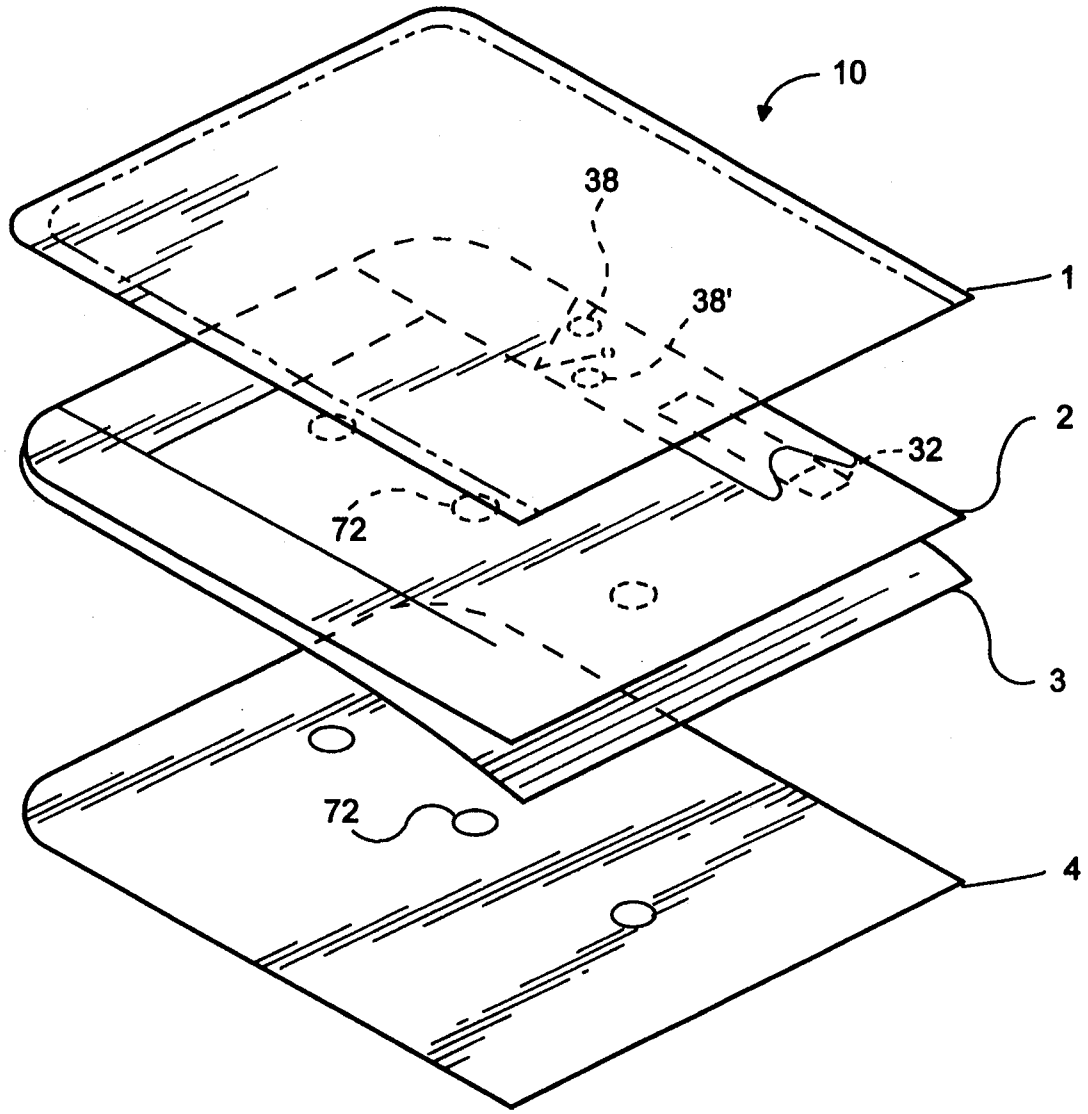
FIG. 20 is a perspective view of a tenth preferred embodiment of an inflatable packaging device according to the present invention.
Figure 21:
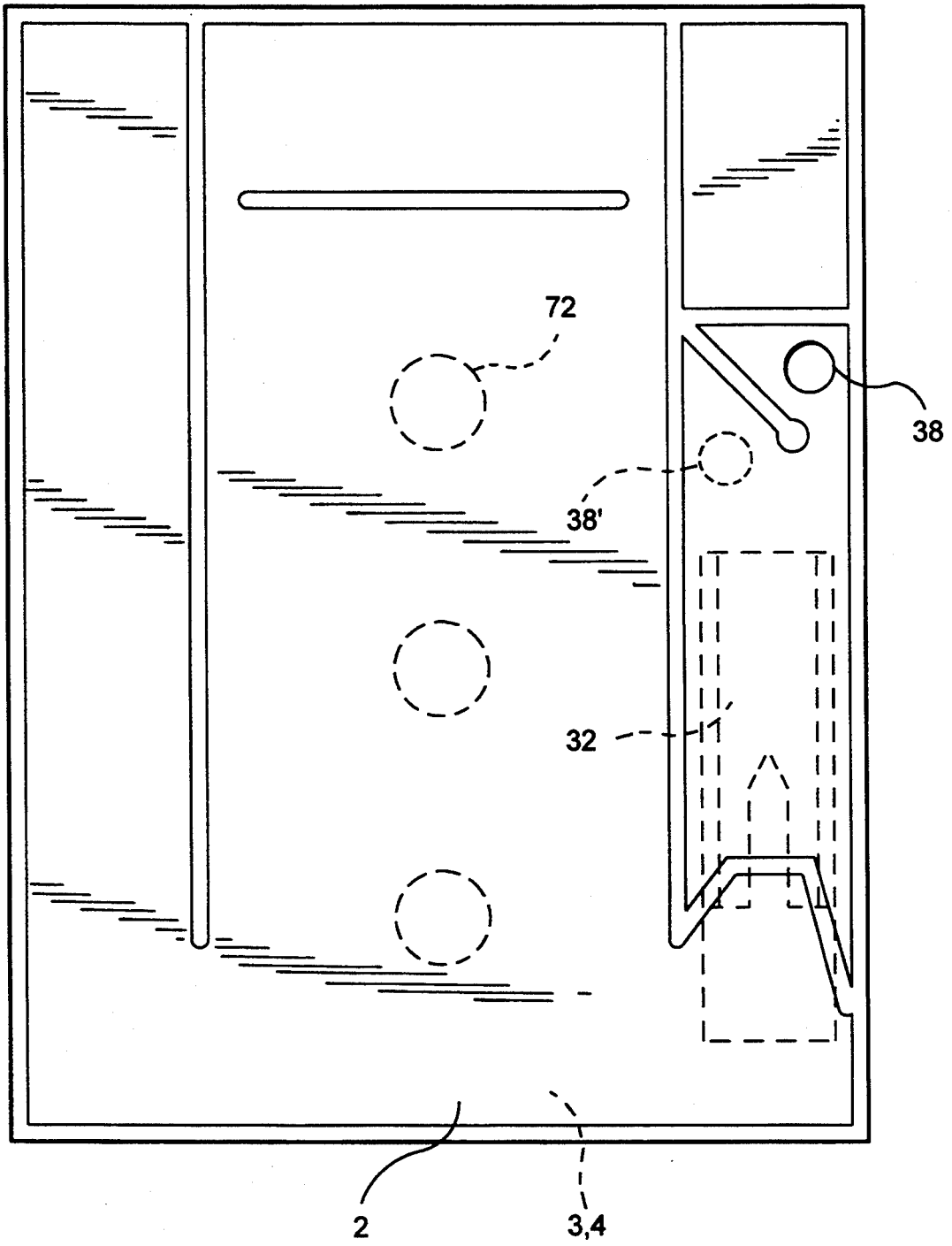
FIG. 21 is a top view of the inflatable packaging device shown in FIG. 20.

FIGS. 20 and 21 show a tenth preferred embodiment of the present invention involving a modified structure in which the respective inner and outer panels 3 and 4 forming one of the inflation chambers such as the bottom inflatable chamber may be fastened together at a plurality of selected locations other than the peripheral edges so that the overall effect resembles a tufted or quilted exterior surface. The fastening points 72 may be created in any suitable way such as by spot heat sealing or stitching and the like. Heat sealing is preferred for its efficiency in connection with automated manufacturing techniques, but the invention is not limited to the use of heat seals. Another possible method for creating the fastening points 72 involves the use of u.v. curing adhesives. Such an arrangement serves to reduce the overall bulk of the composite inflated package and also improves the aesthetic appearance of the package. Although any suitable pattern or design may be used, as desired, it is preferred that the number and effect of such fastening points 72 be suitably limited to reduce the bulk of the package without otherwise interfering with the inflation of the lower inflatable chamber.

As shown in FIGS. 20 and 21, the holes 38, 38' through the inner panels 2 and 3 within the inflating portion 30 are not co-extensive. The construction of the inflatable packaging device is otherwise similar to that illustrated in FIGS. 7 and 8 and described above.

Figure 22:
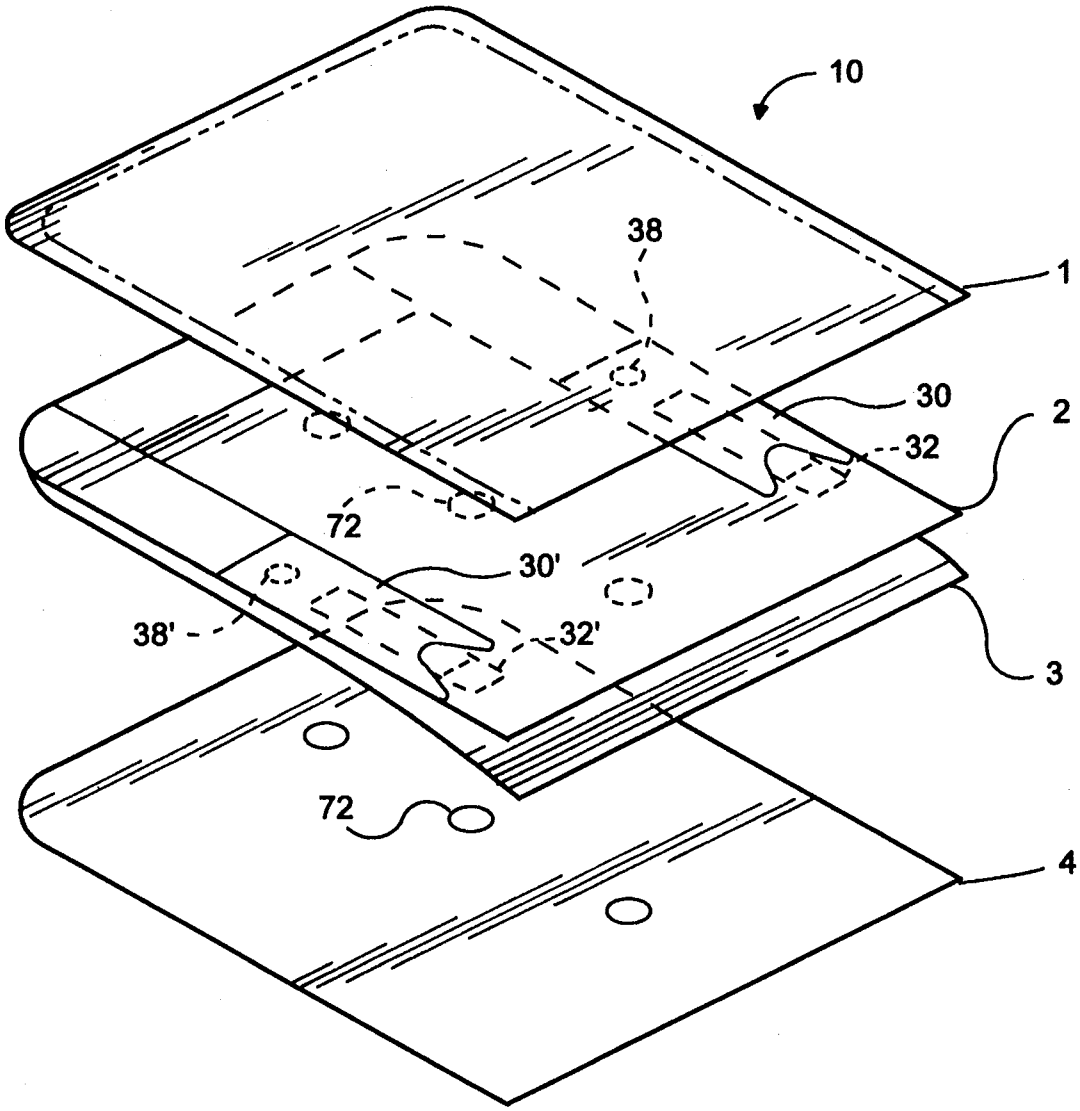
FIG. 22 is a perspective view of an eleventh preferred embodiment of an inflatable packaging device according to the present invention.
Figure 23:
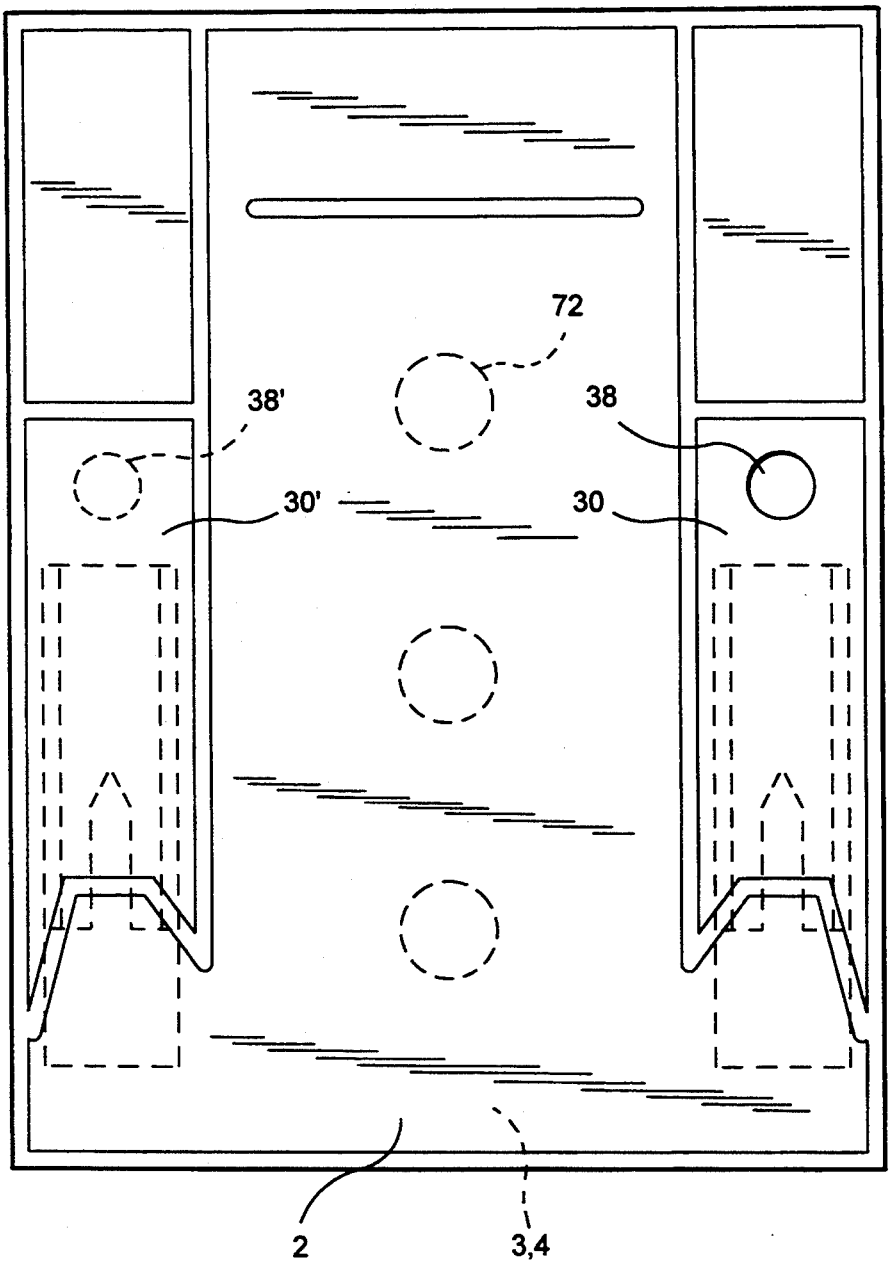
FIG. 23 is a top view of the inflatable packaging device shown in FIG. 22.

FIGS. 22 and 23 illustrate an eleventh preferred embodiment of the present invention which is a variation of the preferred embodiment illustrated in FIGS. 20 and 21 and described immediately above. In this embodiment, there are two inflating portions 30 and 30'. One inflation portion 30 contains a hole 38 through inner panel 2 within the inflation portion 30. The other inflation portion 30' contains a hole 38' through inner panel 3 within the inflation portion 30'. This arrangement permits separate inflation of the upper and lower inflatable chambers. The provision for separate inflation of the inflatable chambers permits appropriate inflation of the quilted and non-quilted inflatable chambers for the best fit of the inflatable packaging device 10 around the article A in the item-receiving zone or pocket 5 when the inflatable chambers are inflated.

Figure 24:
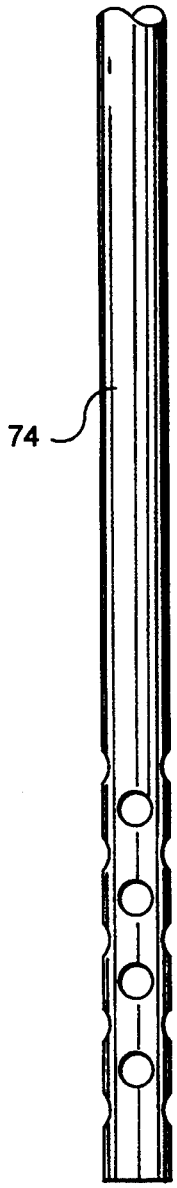
FIG. 24 is a perspective view of a deflating straw of an embodiment of an inflatable package according to the present invention.

FIG. 24 illustrates another preferred embodiment of the present invention. A reusable deflation device 74 is constructed from a tube or straw with holes cut out of the body of the tube or straw at one end thereof. The reusable deflation device 74 may be used with any of the preferred embodiments hereinbefore described. The end of the reusable deflation device 74 with the holes cut into the body of the tube or straw is inserted into the inflating portion 30 of an inflated inflatable packaging device 10 so that at least one of the holes in the body of the tube or straw is at least partially co-extensive with at least one of the holes 38, 38' in the inner layers 2 and 3 within the inflating portion 30. The other open end of the reusable deflation device 74 should remain outside the inflatable packaging device 10. The inflation medium within the inflatable chamber or chambers is then free to pass through the holes 38, 38', through the holes in the body of the tube or straw and along the interior of the tube or straw to the outside of the inflatable packaging device 10. In this manner, an inflated inflatable packaging device may be completely deflated. Further, when the reusable deflation device 74 is not in use, it may be stored in a pocket within the inflatable packaging device 10, as illustrated in FIG. 10.

The structures are not limited to an inflatable packaging device having precisely the two inflatable chambers as described herein. Multiple chambers of any appropriate number and size may be formed in any of the preferred embodiments without departing from the scope of the invention.

A major advantage of the present invention is the flexibility provided in constructing the inflatable packaging system to meet different packaging needs. It should be noted that the size and shape of the item-receiving zone or pocket may be varied without departing from the scope of the present invention.

Thus there is provided in accordance with the invention a novel and highly effective inflatable packaging device that is adapted to enclose and protect an article during shipping and the like and that accomplishes the objects of the invention as set out above. A method of employing the device to full advantage is also provided. Many variations or modifications of the present invention can be envisioned by one of ordinary skill in the art. Accordingly, the invention is intended to include all structure and methods that fall within the scope of the appended claims.

I claim:

1. An inflatable package adapted to be formed into a packaging system for retaining an article therein comprising:

a pair of overlying inner panels defining a pocket therebetween adapted to have an article retained therein and an inflating portion for communicating through said overlying inner panels;

a pair of outer panels each overlying a respective one of said inner panels, each said outer panel being associated with a different one of said inner panels to form an inflatable chamber therebetween;

securing means for securing overlying edge portions of said inner and outer panels together, except at one side of said package whereat only overlying edge portions of each respective pair of said inner and outer panels are secured together and said inner panels thereof remain unattached to each other to expose said pocket and said inflating portion thereat;

inflating means for at least partially inflating said inflatable chambers with a filler medium;

wherein said inflating means extends between said inner panels within said inflating portion for communicating said filler medium to said inflatable chambers; and said inflatable chambers are sealed upon inflation by inflation pressure from said inflatable chambers acting upon said inflating portion.

2. The inflatable package according to claim 1 wherein said panels are generally rectangular and are co-extensive with each other.

3. The inflatable package according to claim 1 wherein each of said panels is composed of a gas impervious, flexible material.

4. The inflatable package according to claim 1 wherein said inflatable chambers are at least substantially filled with said filler medium to at least substantially encapsulate and compress said inflatable chambers against said article to retain said article within said pocket.

5. The inflatable package according to claim 1 wherein said filler medium comprises a pressurized fluid.

6. The inflatable package according to claim 1 wherein said filler medium comprises foam.

7. The inflatable package according to claim 1 wherein said inflating portion is formed by bonding said inner panels along an interior portion of said inner panels to separate said inflating portion from said pocket.

8. The inflatable package according to claim 1 wherein said inflating means communicates through said inner panels via respective co-extensive holes in said inner panels within said inflating portion.

9. The inflatable package according to claim 8 wherein said inflating means comprises a flat valve within said inflating portion.

10. The inflatable package according to claim 9 wherein said inflating means further comprises a tack seal connecting said flat valve to either or both of said inner panels.

11. The inflatable package according to claim 1 wherein said inflating means communicates through said inner panels via respective holes in said inner panels within said inflating portion which are not co-extensive.

12. The inflatable package according to claim 11 wherein said inflating means comprises a flat valve within said inflating portion.

13. The inflatable package according to claim 12 wherein said inflating means further comprises a tack seal connecting said flat valve to either or both of said inner panels.

14. The inflatable package according to claim 8 wherein said inflating means comprises an adhesive applied between said inner panels within said inflating portion.

15. The inflatable package according to claim 8 wherein said inflating means comprises a blocking baffle which is folded and seals said inflating portion.

16. The inflatable package according to claim 14 wherein said inflating means further comprises a blocking baffle which is folded and seals said inflating portion.

17. The inflatable package according to claim 14 wherein said adhesive is selected from the group consisting of oils, non-oily fluids, coatings and inks.

18. The inflatable package according to claim 8 wherein said inflating means comprises an inflation tube which is sealed in place so that an open end of said inflation tube is within said inflating portion spaced from said holes.

19. The inflatable package according to claim 18 wherein said inflation tube comprises a cap attachable to said inflation tube at an open end of said inflation tube external to said inflating portion.

20. The inflatable package according to claim 8 wherein said inflating portion further comprises a series of bonded areas at which the inner panels are bonded together to minimize the separability of said inner panels within said inflating portion to form a seal within said inflating portion upon inflation.

21. The inflatable package according to claim 8 wherein said inflating means further comprises a relatively wide tube sealed within said inflating portion through which a narrower inflation tube may be inserted into said inflating portion.

22. The inflatable package according to claim 8 further comprising a flap placed over said holes and within one said pair of inner and outer panels defining an inflatable chamber and sealed in place by said securing means.

23. The inflatable package according to claim 11 wherein one said pair of inner and outer panels defining an inflatable chamber further comprises a plurality of bonded areas connecting said pair of inner and outer panels in a center portion of said inflatable chamber forming said inflatable chamber into a quilted chamber upon inflation.

24. The inflatable package according to claim 23 wherein said inflating portion comprises two separate inflating portions, each of which comprises a flat valve and each of which is used to inflate one of said inflatable chambers.

25. The inflatable package according to claim 1 further comprising a deflating tube with a plurality of holes cut into said deflating tube to act as a deflation device upon insertion of said deflating tube into said inflating portion.

26. An inflatable package adapted to be formed into a packaging system for retaining an article therein comprising:

a pair of overlying inner panels defining a pocket therebetween adapted to have an article retained therein and an inflating portion for communicating through said overlying inner panels;

a pair of outer panels each overlying a respective one of said inner panels, each outer panel being associated with a different one of said inner panels to form an inflatable chamber therebetween;

securing means for securing overlying edge portions of said inner and outer panels together, except at one side of said package whereat only overlying edge portions of each respective pair of said inner and outer panels are secured together and said inner panels thereof remain unattached to each other to expose said pocket thereat;

inflating means for at least partially inflating said inflatable chambers with a gas formed internally to said inflatable chambers;

wherein said inflatable chambers are sealed upon inflation by inflation pressure from said inflatable chambers acting upon said inflating portion.

27. A method for packaging an article comprising the steps of forming a pocket and an inflating portion from a pair of overlying inner panels;

forming a pair of inflatable chambers from a pair of outer panels each overlying a respective one of said inner panels, each outer panel being associated with a different one of said inner panels;

securing overlying edge portions of said inner and outer panels together, except at one side of said package whereat only overlying edge portions of each respective pair of said inner and outer panels are secured together and said inner panels thereof remain unattached to each other to expose said pocket and said inflating portion thereat;

placing an article within said pocket;

at least partially inflating said inflatable chambers with a filler medium through said inflating portion, which communicates said filler medium through said inner panels to said inflatable chambers; and sealing said inflatable chambers upon inflation by inflation pressure from said inflatable chambers acting upon said inflating portion.

28. The method of claim 27 further comprising at least substantially filling said inflatable chambers with said filler medium to at least substantially encapsulate and compress said inflatable chambers against said article to retain said article within said pocket.

29. The method of claim 27 further comprising forming one said inflatable chamber into a quilted chamber with a plurality of bonded areas connecting said pair of inner and outer panels in a center portion of said inflatable chamber.

* * * * *